US005249321A

United States Patent [19]

Graf

[11] Patent Number: 5,249,321

[45] Date of Patent: Oct. 5, 1993

[54] EVACUATION OR RESCUE DEVICE FOR A NON-AMBULATORY PERSON

[76] Inventor: Jorg W. Graf, R.R. #2, Sharbot Lake, Ontario, Canada, K0H 2P0

[21] Appl. No.: 654,101

[22] Filed: Feb. 11, 1991

[30] Foreign Application Priority Data

Aug. 28, 1990 [CA] Canada ..... 2024126

[51] Int. Cl.[5] ..... A61G 1/00; A61G 7/08

[52] U.S. Cl. ..... 5/494; 5/81.1; 5/424; 5/626; 5/628; 280/8; 280/845

[58] Field of Search ..... 5/81 R, 82, 89, 424, 5/494; 280/8, 845, 19, 28.11; 128/869, 870, 872, 873

[56] References Cited

U.S. PATENT DOCUMENTS

| | | | |
|---|---|---|---|
| 1,711,167 | 4/1929 | Blake | 5/82 X |
| 2,309,464 | 1/1943 | Lucci et al. | 5/82 |
| 2,703,412 | 3/1955 | Stone | 5/82 |
| 3,110,912 | 11/1963 | Propst . | |
| 3,134,110 | 5/1969 | Gamichon | 5/494 X |
| 4,046,393 | 9/1977 | Vadnais | 280/19 |
| 4,067,079 | 1/1978 | Buchman | 5/81.1 |
| 4,124,908 | 11/1978 | Burns et al. | 5/82 R |
| 4,186,453 | 2/1980 | Burns et al. | 5/82 R |
| 4,283,068 | 8/1981 | Keyser | 280/19 |
| 4,601,075 | 7/1986 | Smith | 5/82 R |
| 4,736,474 | 4/1988 | Moran et al. . | |
| 5,016,299 | 5/1991 | Boulanger | 5/81.1 |
| 5,050,254 | 9/1991 | Murphy | 5/625 |

FOREIGN PATENT DOCUMENTS

| | | | |
|---|---|---|---|
| 0165043 | 12/1985 | European Pat. Off. . | |
| 0233782 | 8/1987 | European Pat. Off. . | |
| 0371525 | 6/1990 | European Pat. Off. . | |
| 2263605 | 7/1973 | Fed. Rep. of Germany . | |
| WO8607253 | 12/1986 | PCT Int'l Appl. . | |
| 8909039 | 10/1989 | PCT Int'l Appl. | 5/82 R |
| 1434832 | 5/1976 | United Kingdom | 5/89 |
| 2030047 | 4/1980 | United Kingdom | 5/82 R |
| 1584102 | 2/1981 | United Kingdom | 5/81 R |
| 2157558 | 10/1985 | United Kingdom | 5/81 R |
| 2182570 | 5/1987 | United Kingdom | 5/82 R |

*Primary Examiner*—Michael F. Trettel

*Attorney, Agent, or Firm*—Sterne, Kessler, Goldstein & Fox

[57] ABSTRACT

An evacuation or rescue device for a bed-ridden or non-ambulatory person adapted to quickly secure the person to a movable underlying mattress or the like comprises two sheets deployable one from the head-end and one from the foot-end. When deployed the head-end sheet meets the foot-end sheet over the persons chest or abdomen; the head-end sheet having an opening for the head. The two sheets, which are interconnected underneath the mattress, are then tightened downwardly over the long sides of the mattress by means of looped ropes pulled one from the head-end side and the other from the foot-end side. The ropes are self cleating when tightened and quickly secure the person in readiness for rescue and evacuation by a single individual if necessary.

48 Claims, 17 Drawing Sheets

EVACUATION OR RESCUE DEVICE FOR A NON-AMBULATORY PERSON

BACKGROUND OF THE INVENTION

1. Field of the Invention

The present invention relates generally to rescue and/or evacuation devices for non-ambulatory or bed-ridden persons. More particularly, the invention relates to such a device in which a patient may be rapidly and securely enclosed before transfer or evacuation.

2. Prior Art of the Invention

An Evacuation Mattress is disclosed in International Application Number PCT/NL 86/00015 published Dec. 18, 1986 under No. WO 86/07253 based on a Netherlands application filed Jun. 12, 1985. The mattress is characterized by belts or ropes to be put around the patient, which are permanently fastened to the mattress.

Other prior art devices for evacuating non-ambulatory persons have also included boards or mats to support a patient. For example, U.S. Pat. No. 4,793,008 issued Dec. 27, 1988 to Johansson discloses rigid yet flexible mats for placing under the patient with a strap each for securing the patient across the chest and thighs. A relatively complicated Rescue Transportation Device is disclosed in U.S. Pat. No. 4,736,474 issued Apr. 12, 1988 to Moran et al, wherein an inflatable support member and crossed straps are used to secure the person being transported.

A child Restraint Device With Removable Semi-Rigid Support is disclosed in U.S. Pat. No. 4,627,428 issued Dec. 9, 1986 to Brooks. It includes a semi-rigid base and a cover attachable to the base so as to secure the child between the base and the cover. A restraining harness on top of the cover secures the entire arrangement to a transporting device.

There are numerous other patents and patent applications employing rigid or semi-rigid supports and belts or straps to secure the person transported to the support. One apparent disadvantage to the use of straps or belts is that they could exert undue or excessive pressure on the bodies of some evacuees, such as in the case of recent surgery patients. Another disadvantage that is not obvious is that the use of straps or the like harnesses delays the process of readying the patient for rescue and evacuation such as in the case of a hospital fire.

SUMMARY OF THE INVENTION

The present invention endeavors to provide a rescue/evacuation device that is rapidly deployable and that does not adversely affect the patient's body once deployed, and permits evacuation thereof by one person if necessary.

Accordingly, the present invention provides an evacuation device for a non-ambulatory person. The device comprises sheet means for enclosing the person between a mattress and the sheet means and securement means for forcing the sheet means against the mattress.

In another aspect of the device comprises covering means of use in covering said person and, attached to said covering means, means of use in supporting and moving said person on a surface.

In still another aspect the device comprises covering means of use in covering said person, enclosing means attached to said covering means and securement means, engaging said enclosing means, to securely enclose said person between said covering means and said securement means.

In one aspect the invention provides such a device wherein said sheet means comprises at least one sheet of flexible material and said securement means comprises at least one first securement member, at least one second securement member and at least one third securement member, said first member securing said sheet means to said mattress such that said sheet means is deployable so as to cover a substantial portion of said person and of the upper surface of said mattress, said second member being secured to said mattress, and said third member being engageable with said second member to enclose said person between said mattress and said sheet means.

In another and preferred embodiment the invention provides such a device for transporting a bed-ridden person, and adapted to remain under a bed mattress until needed, comprising;

A central sheet portion having approximately the size of a mattress and adapted to underlie the mattress, a panel portion at each of the foot and head of the central sheet, adapted to remain folded under the mattress while not in use, and to unfold when needed to overlie the person by covering the head and foot ends of the mattress, and meet at a central part of the mattress, with a means for fixing the meeting portions removably in place, whereby to form a retaining panel over the person, said head end portion presenting an aperture for the head of the person, strand operated means adapted to draw the retaining panel downwardly the towards the central underlying sheet to tighten the retaining sheet against the mattress and retain the person securely within, said strand operated means comprising on each side of the device a strand attached to a first anchorage point on the edge of the foot end panel intermediate the forward moving edge and the central sheet portion edge of the foot end panel, and passing through a guide attached to the central sheet, and terminating at a second anchorage point on the foot end panel adjacent to the forward moving edge thereof;

whereby when the foot end panel is deployed by pulling it up over the person and affixing it to the meeting portion of the head end panel the strand on each side is pulled longitudinally along the mattress, and the first and second anchorage points are drawn further apart, whereby the side edge of the central sheet is drawn towards the adjacent side edge of the retaining sheet formed by the foot and head end sheets, whereby to retain the person firmly in place against the mattress. Suitably, the guide comprises a slotted runner adapted to move along a bead forming an edge of the central sheet, and the guide includes a passage for the strand to permit movement of the strand through the guide during deployment, and facilitate tightening of the strand.

An improvement of the device of the present invention provides an evacuation or rescue device for a non-ambulatory person, comprising:

at least one sheet for covering substantially all of said person;

at least one cord for enclosing said person between said at least one sheet and a support for said person; and at least one cleat, attached to a respective first area of said at least one sheet and for deployment along the upper surface of said support.

A further improvement on the above invention provides an evacuation device for a non-ambulatory person adapted to cooperate with, and be secured to, a mattress, stretcher, or like horizontal rest means, comprising at least two sheets of use in covering said person;

at least two pairs of cords, each pair fixedly attached to a respective sheet of said at least two sheets and slidably attached to respective handles attached to respective sheets of said at least two sheets;

and securement means engaging said cords, to securely enclose said person between said sheets and said securement means;

said securement means comprising for each pair of cords at least two cleats, each of which is fixed to a respective edge of one of said at least two sheets and having an opening for travel of a respective one of said at least four cords.

BRIEF DESCRIPTION OF THE DRAWINGS

Certain embodiments of the invention will now be described in detail with reference to the annexed drawings, in which.

DETAILED DESCRIPTION OF THE DISCLOSED EMBODIMENTS

Figure 1:
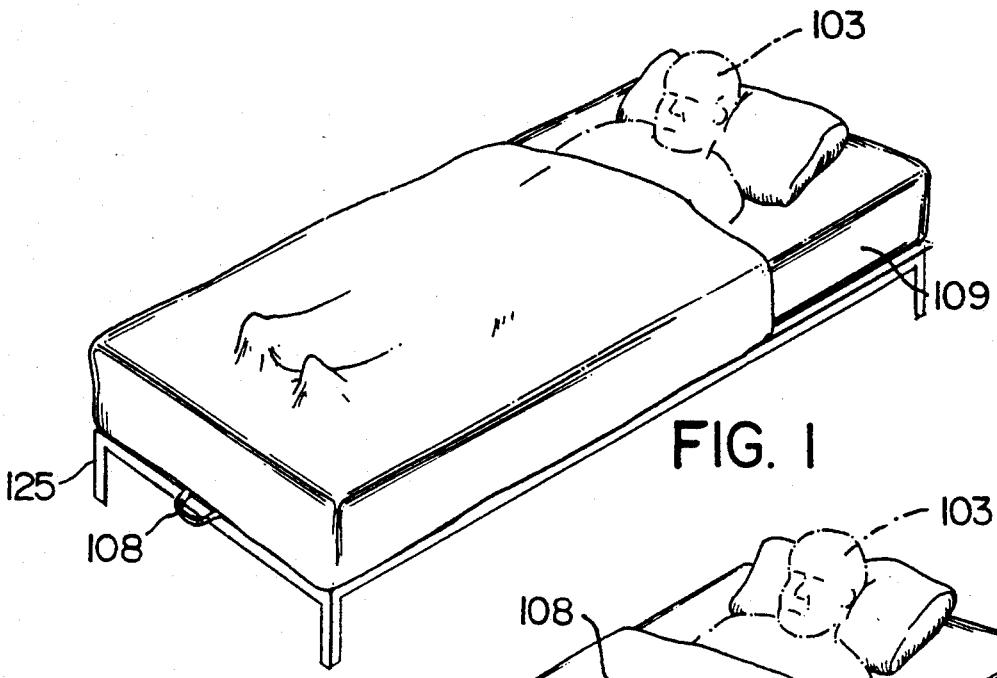
FIGS. 1, 2, and 3 are sequential perspective views showing deployment of an evacuation device according to the present invention.

Referring to FIG. 1 of the drawings, it shows a person 103 lying on a mattress 109 on a bed frame 125. Visible at the foot end of the bed frame 125 is a handle 108 attached to the evacuation device, which is disposed under the mattress ready for deployment. A handle similar to the handle 108 extends beyond the head end of the mattress 109.

Figure 2:
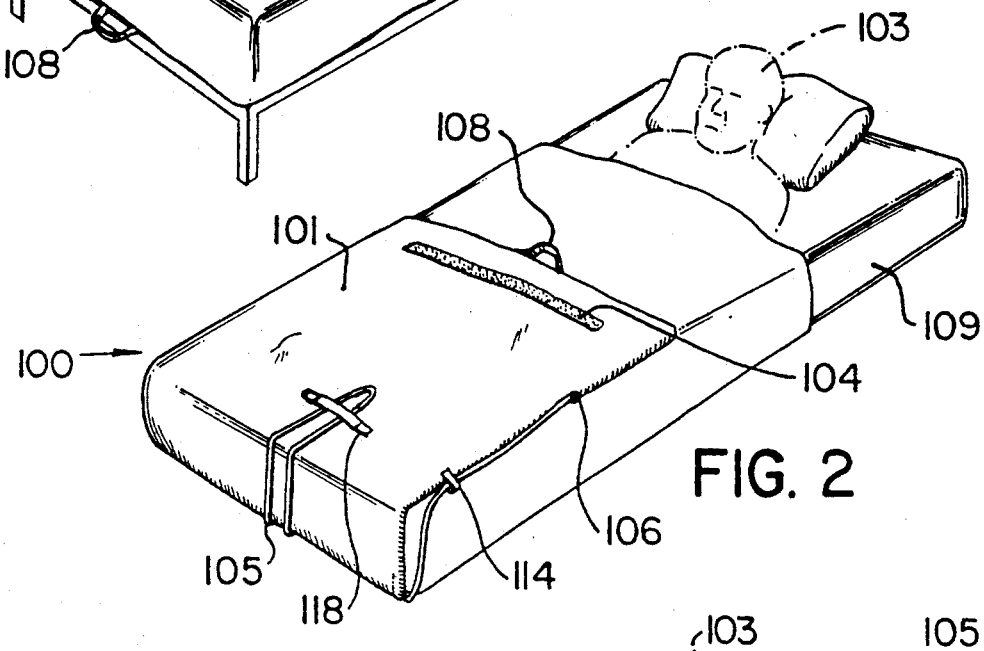

FIG. 2 shows that by pulling the handle 108 of an evacuation device shown generally at 100, a top cover 101 is drawn out from its place of storage beneath the foot end of the mattress 109. The top cover 101 may include a webbing. Along with such a top cover 101 a further handle 105, which is preferably a cord, is drawn out, releasably held against the top cover 101 by a loop 118. The "cords" and "strands" referred to herein are preferably pre-stretched sailing rope 3/16 of an inch in diameter. Each end of the cord 105 is fastened to an edge of the top cover 101 by stitching at an edge point (as well as on the other, unseen, side) 106 and runs through loops 114 along the edges of the top cover 101. (The routing of the cord 105 between the head and foot ends of the mattress 109 and the longitudinal lower edges thereof, below the edge point 106, will be described in detail below in conjunction with FIGS. 5 through 15.) One end of the loop 118 is sewn to the top cover 101 and the other end is releasably fastenable by complimentary hook and loop fastening material, such as VELCRO TM, to enclose and retain the cord 105 when the cord 105 is drawn out with the top cover 101.

By pulling the top cover 101 over the person 103 and the foot of the mattress 109, towards the opposite (head) end of the mattress 109, the cord 105 and top cover 101 are disposed to facilitate securely enclosing the person 103 between the top cover 101 and the mattress 109.

Figure 3:
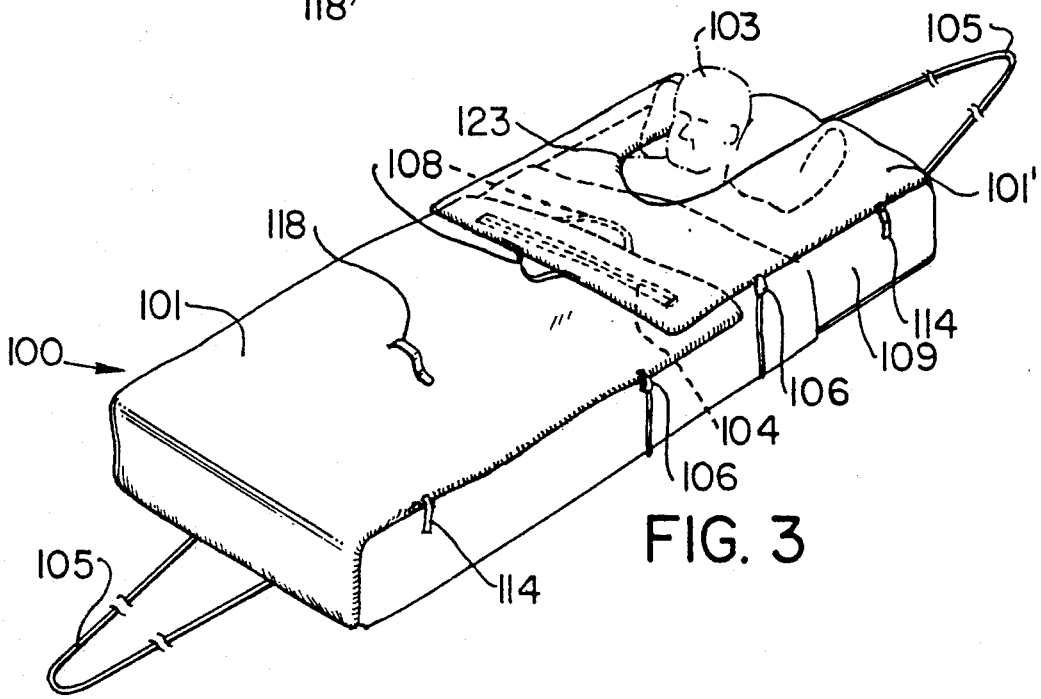
Figure 4:
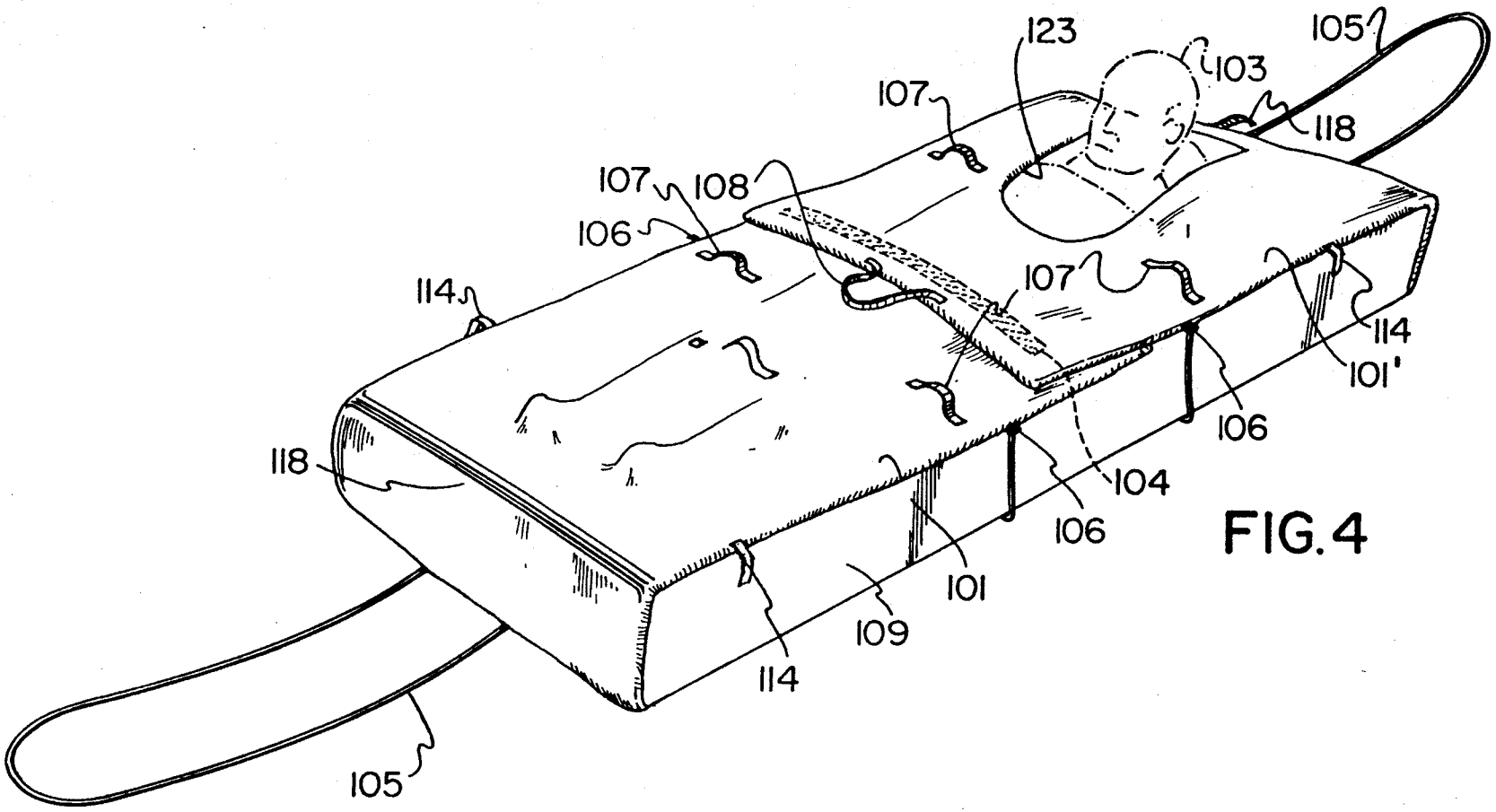
FIG. 4 is a perspective view of a variation of the evacuation device shown in FIG. 3, fully deployed and in use.

Referring to FIGS. 3 and 4, the top cover sheet 101′ at the head end of the mattress 109 includes an opening 123 for the head of the person 103. The top covers 101 and 101′ preferably are made of STAPH CHECK 20 TM, sold by Herculite Products Inc. of New York, N.Y. A flexible high tensile strength sheet material, preferably including a heat reflective material such as metallic coated plastic film, such as MYLAR TM, may be used as an alternative.

It is also preferred that each top cover 101 and 101' be longer than half the length of the mattress 109. In use, the top covers 101 and 101' are extended toward the head and foot ends of the mattress 109 respectively, and they overlap. They are then fastened to one another, suitably by strips 104, with such strips made from complimentary hook and loop fastening material, such as VELCRO TM strips. By pulling on the cords 105, the long edges of the top covers 101 and 101' are drawn down towards the lower edge of the mattress 109, securely enclosing the person 103 between the top covers 101 and 101' and the mattress 109.

Figure 5:
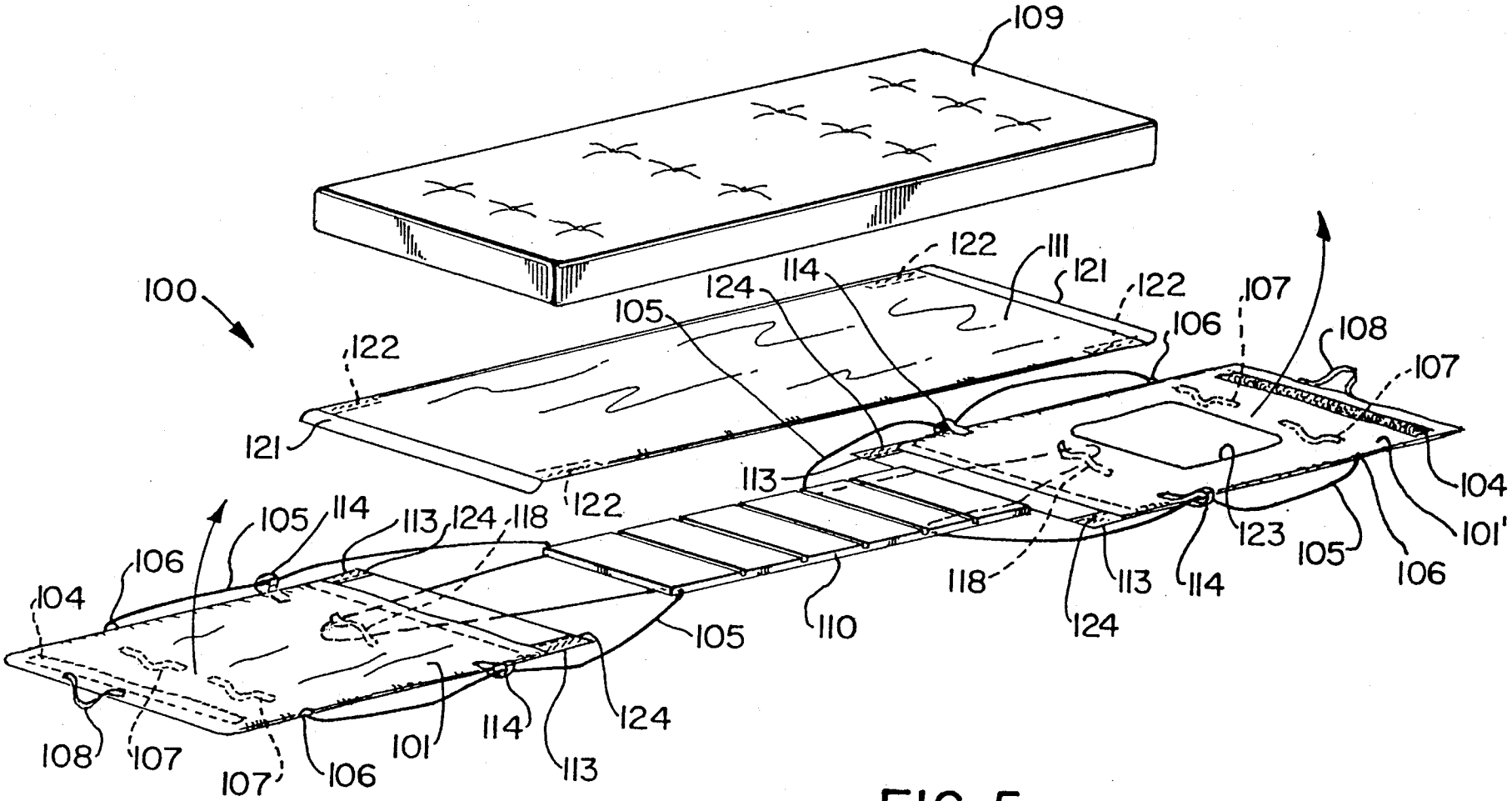
FIG. 5 is an exploded perspective view of the evacuation device shown in FIG. 4.

With reference now to FIG. 5, in the absence of a mattress, when the top covers 101 and 101' are drawn together they secure the person 103 to a sled 110, to a sheet 111, or to a sled-sheet assembly described in detail below with reference to FIGS. 5 through 15.

Enclosure of the person 103 by the top cover sheets 101 and 101' secures the person 103 onto the mattress 109.

Referring to the embodiment shown in FIG. 4, each top cover 101 and 101' includes handles 107 on its upper surface. Such further handles 107 are of use in lifting the device and person 103 from a bed to a floor. Thereafter, the device and person 103 may be pulled along the floor using either cord 105.

Referring to FIG. 5, a device shown generally at 100 includes a sheet 111, between the mattress 109 and the rest of the device 100. The sheet 111 includes, at each end, a flap 121 for covering the respective top covers 101 and 101' when they have been stored in pockets 102. The pockets referred to herein are not essential to the invention but are preferred, to keep the top covers 101 and 101' out of the way of bed clothes. The sheet 111 is attached to the rest of the device 100 by strips 122, with such strips made from complimentary hook and loop fastening material such as VELCRO TM strips, on the corners of the lower face of the sheet 111 which engage matching Velcro strips 124 on the top of coverings 113. The coverings 113 cover grooves through which the cord 105 is originally placed.

Figure 6:
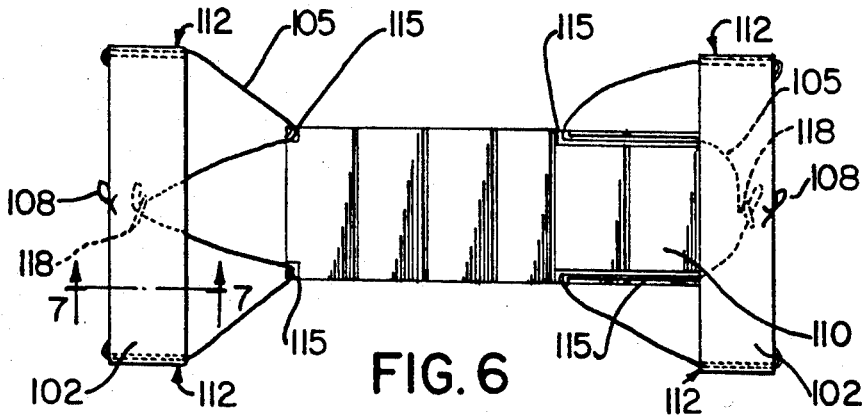
FIG. 6 is a plan view of the evacuation device shown in FIG. 1, with the mattress omitted.

In FIG. 6, the sheet 111 has been omitted in the device 100, for the purposes of clarity. At each end of the device 100 a cord 105 extends from the loop 118 through the back of the pouch 102, into grooves 115 near the corners of the sled 110. Exiting from the grooves 115, the cord 105 extends back toward the pouches 102 on each side of the cover 101. The cords 105 extend along grooves 112 under the covers 113 and then pass into the pouches 102, under the pouch lids 121. In the pouches 102 the cords 105 are folded up along the lateral edges of the top covers 101 and 101'. The cords 105 are kept in place therealong by the loops 114 and by being attached to the top covers 101 and 101' at points 106.

Figure 7:
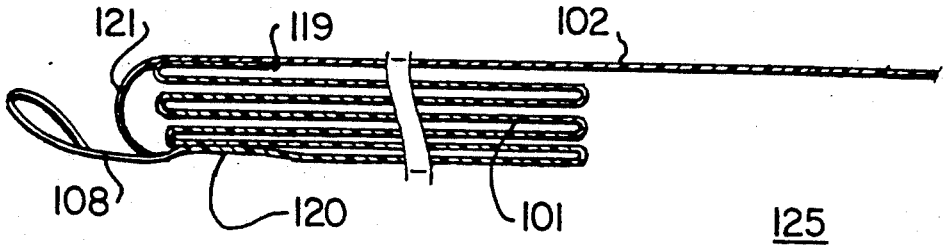
FIG. 7 is a cross-sectional view along the line A—A in FIG. 6.

Referring to FIG. 7, top cover 101 is stored in an accordion-folded manner under the foot end of the mattress 109. For the purposes of clarity, the cord 105 has not been included in the Figure.

Before use, each folded top cover 101 and 101' is stored in a respective pouch 102. Such pouches 102 are connected to the sled 110 and/or the sheet 111 which is preferably of a low friction material such as cloth coated with TEFLON TM (trade mark for polytetrafluoroethylene). The device 100 then forms a single unit, the lower surface of which is attached to the upper surface of a bed frame 125. Alternatively, the upper surface of the device 100 is attached to the lower surface of the mattress 109. In either event, Velcro may be used to affix the device 100. Also in either event, as shown in FIG. 8, a pair of guide grooves 112 adjacent to each pouch 102 receives the cord 105 to facilitate the cord 105 moving past corners of the mattress 109 when the cord 105 is pulled.

Top cover 101 is attached to pouch 102 by stitching at 119. Velcro at 120 is preferred to keep the lid 121 closed until the device is to be used.

Figure 8:
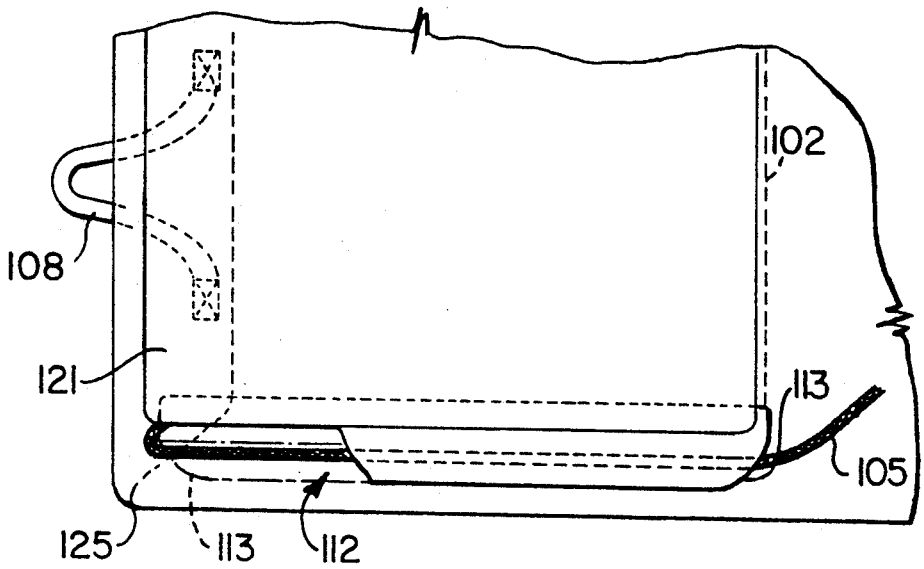
FIG. 8 is a plan view of a detail of the device showing the lower left-hand corner of FIG. 6.

Referring to FIG. 8, the grooves 112 are parallel to the direction in which the cord 105 is pulled and are covered by flexible coverings 113. Preferably, a leading edge and a training edge of the covering 113 of each groove 112 is angled to aid in the cord 105 clearing the corner of the mattress 109.

The first guide grooves 112 are below the mattress 109 corners and configured such that upon the cord 105 being pulled, the cord 105 passes out of the coverings 113 and guide grooves 112 without catching on the corners or the mattress 109. For each guide groove 112 an openable loop 114 is attached to the top cover 101 through which the cord 105 passes when the cord 105 is pulled. If, along the edge of each top cover 101 and 101' parallel to where the grooves 112 would be, a plurality of such loops 114 are attached then they suffice to cause the cord 105 to clear the corresponding corner of the mattress 102, and the grooves 112 are not needed.

Once the top covers 101 and 101' are extended over the person 103 and joined to one another by the Velcro 104 the attachments 106 are approximately opposite transverse openings at the ends of the second grooves 115. By pulling the cords 105, away from the device 100 at each end of the device 100, each cord 105 passes along the grooves 115, drawing its associated cover sheet 101 or 101' down toward the sled 110 and sheet 111. That process will now be described in further detail with reference to FIGS. 9 to 11.

Figure 9:
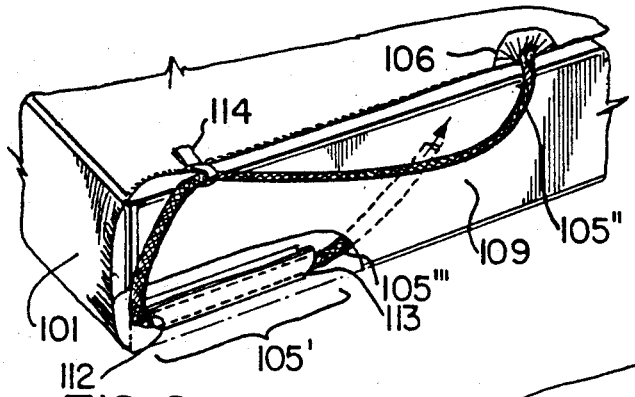
FIGS. 9, 10, and 11 are sequential, partial perspective views illustrating the securement of a sheet to a mattress.

Referring to FIG. 9, before the cord 105 is pulled, a portion 105' of it is in the groove 112, under cover 113, below the mattress 109. Another portion 105'' is along the side of the mattress 109 between the end of the mattress 109 (and groove 112) and the attachment 106. The remainder, 105''', is between the other end of the groove 112 and the sled 110 (not shown) and also extends into and through the sled 110. When the cord 105 is initially pulled the portion 105''' moves, in the plane of the sled 110 (not shown), in the direction shown by the arrow in the Figure.

Figure 10:
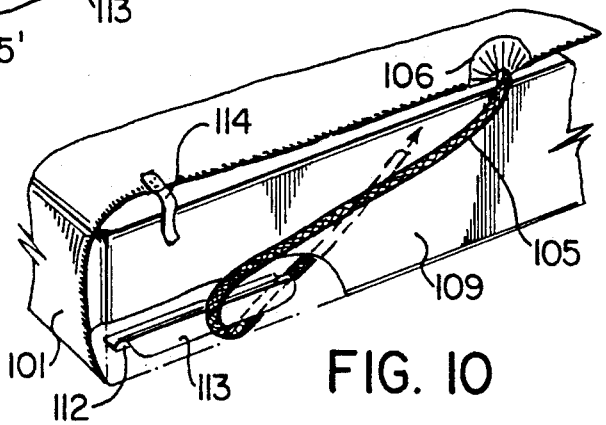

Referring to FIG. 10, as the cord 105 is pulled, the cord 105 passes out of the groove 112, covering 113 and loop 114 and moves toward the opposite end of the mattress 109 and towards a position generally below the attachment 106. The force of pulling on the cord 105 detaches the end of the loop 114 having complimentary hook and loop fastening material, such as VELCRO TM, from the sheet 101.

Figure 11:
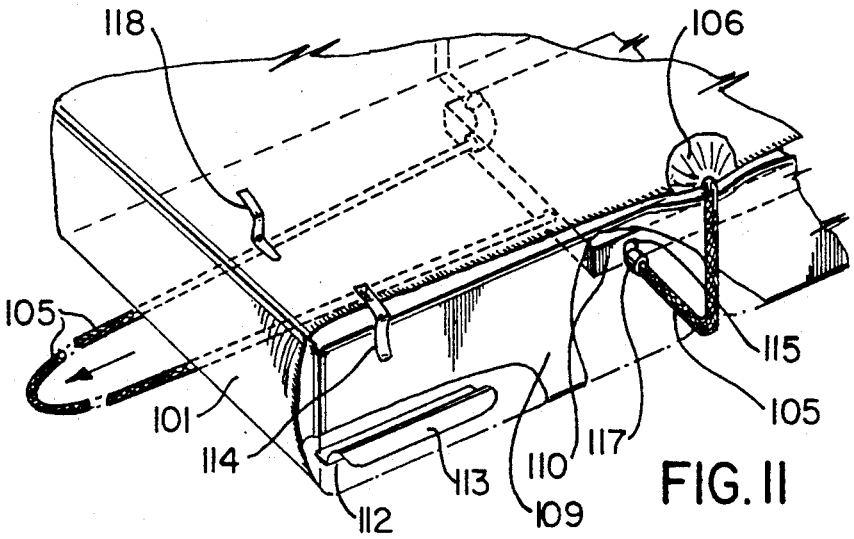

Referring to FIG. 11, in the final state of securing the top cover 101 over the mattress 109 the cord 105 extends from attachment 106 on top cover 101, passes under the mattress 109 and through the sled 110 (along guide grooves 115 in the sled 110) and exits from beneath the end of the mattress 109.

Figure 13:
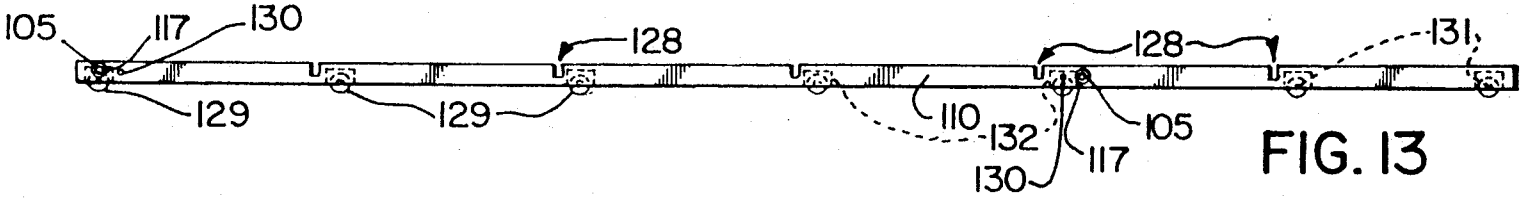
FIGS. 12 and 13 are, respectively, plan and side views of a sled useful for rolling the embodiment shown in FIGS. 1 to 3.
Figure 12:
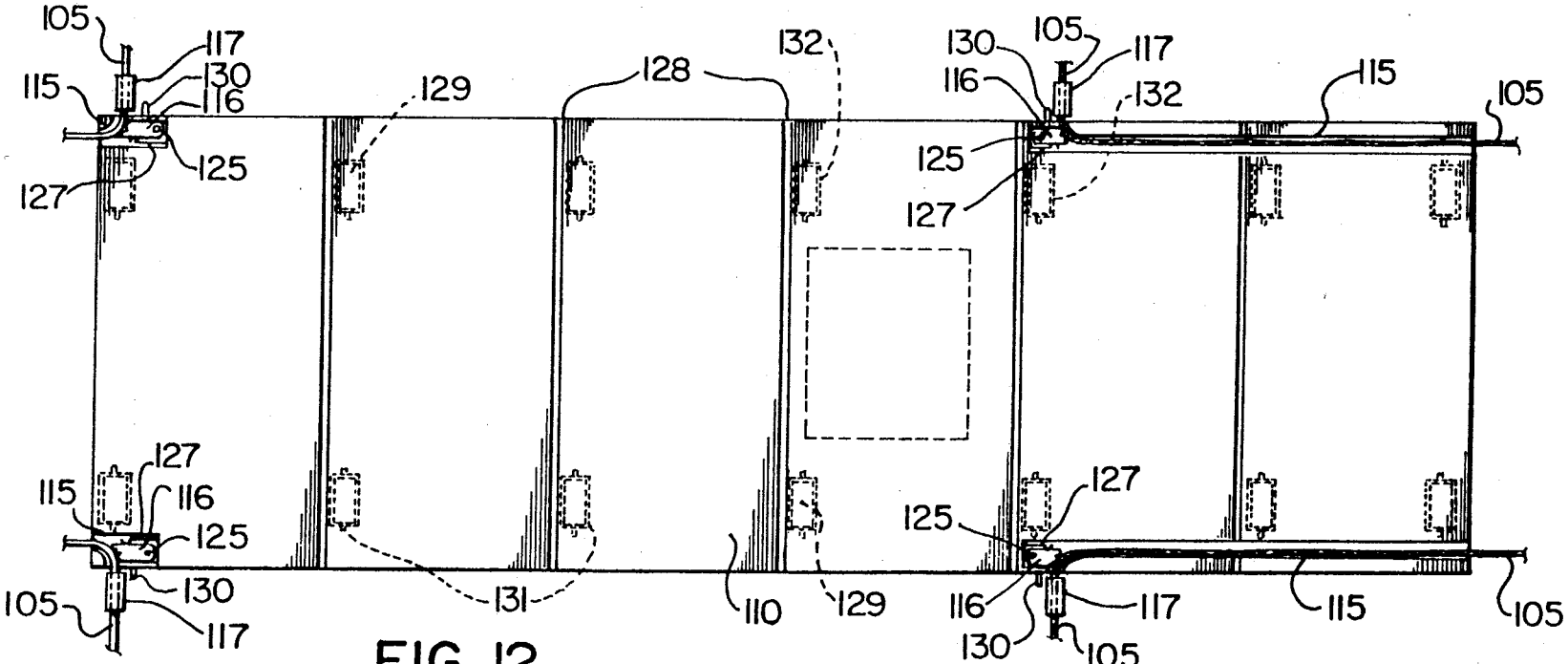

Referring to FIGS. 12 and 13, the sled 110 is preferably made of a rigid material such as injection molded plastic. Such a sled 110 preferably has in its lower surface, runners or bumps for ease of moving the device 100 along a surface, such as a bed frame or floor. In the embodiment shown in FIG. 12, a wheel-axle assembly is mounted in openings 132 in the lower surface of such a sheet 110, such that a wheel 129 in such an assembly will roll on the surface below the device 100. The sled 110 is segmented at 128 to facilitate its conforming to the shape of the mattress 109.

A wheel-axle assembly comprises a wheel 129 having cylindrical cross-section and a rotational axis parallel to the lower surface of the sled 110. Each wheel-axle assembly also comprises an axle 131 attached to the wheel 129 and mounted in the opening 132. Preferably, the wheels 129 are constructed of nylon.

It is also preferred to include an area of high friction material, mounted on the lower surface of the sled 110, to slow the device 100 in its travels e.g. down stairways.

Figure 15:
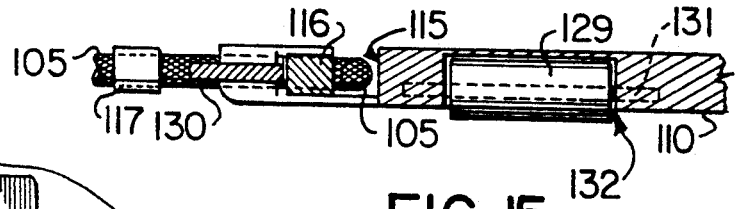
FIG. 15 is a cross-sectional view along the line B—B in FIG. 14.
Figure 14:
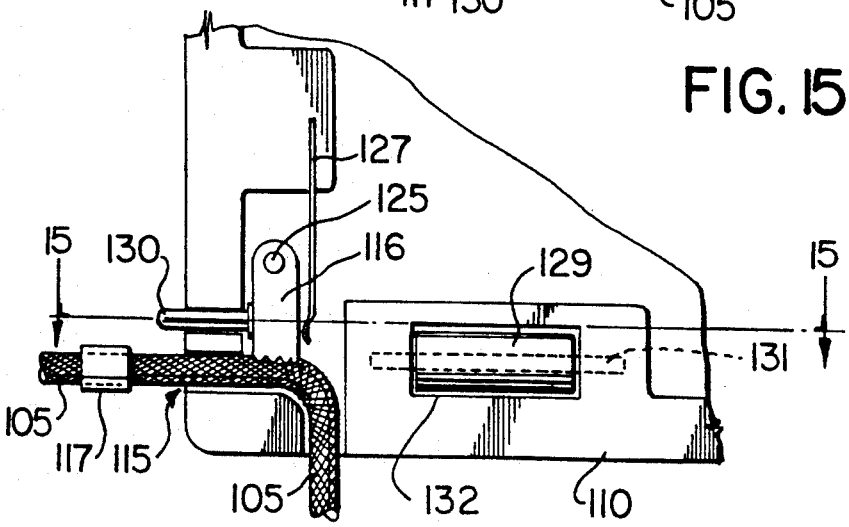
FIG. 14 is a plan view of a detail of the sled depicted in FIGS. 12 and 13.

Referring to the embodiments of FIGS. 14 and 15, the sled 110 further comprises a cleat or ratchet 116 engageable with the cord 105 to retain the tautness of the top cover 101 against the mattress 109 and person 103. The cleat or ratchet 116 is engageable with the cord 105 by plugs or knots 117, extending from the cord 105. The plugs or knots 117 inhibit movement of the cord 105 into the guide grooves 115. The cord 105 can be partly withdrawn from the sled 110 while the cleat or ratchet 116 is disengaged from the cord 105. Such disengagement is achieved by pressing release pin 130 against ratchet 116 such that ratchet 116 pivots about post 125, subject to restraint from spring 127, so that cleat 116 rotates away from cord 105. The cord 105 can then be pulled back along the groove 115 while cleat 116 is disengaged from the cord 105.

In an alternative to the above-described preferred embodiment, a further embodiment need not include the sled 110 and will now be discussed with reference to FIGS. 16 through 22.

Figure 16:
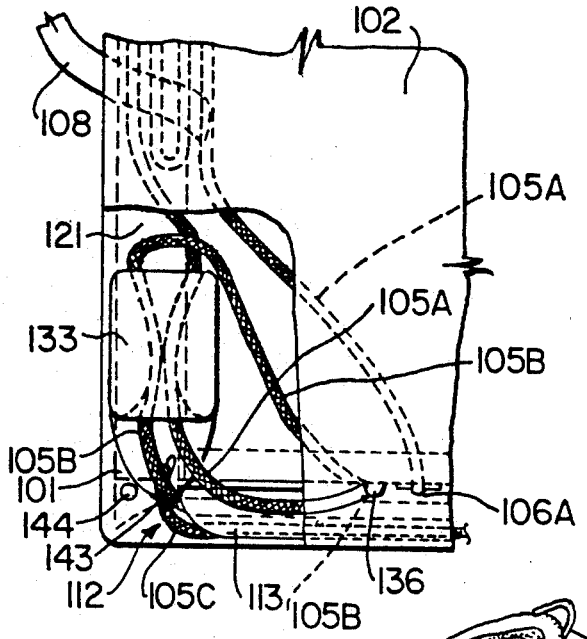
FIG. 16 is a plan view of a detail of an alternative arrangement to that shown in FIG. 8.

Referring to FIG. 16, an upper cord 105A and lower cord 105B pass through a slidable guide 133. The slidable guide 133 is slidable along the cords 105A and 105B and is attached to a pre-stretched cord 105C at 143. The cord 105C is preferably made of a rubberized elastic material and is attached to the guide 133 by an end of the cord 105C being inserted through a hole in the guide 133 and then heating and flattening that end so that its lateral dimensions exceed the size of that hole. The pouch lid or flap 121, fastened as in the previous embodiment, helps to keep the guide 133 and sheet 101 in place inside the pouch 102 and the cord 105C in its pre-stretched condition. A post 144 inside pocket 102 projects upwardly from the base thereof near the corner of the pocket 102. Covering 113, and groove 112 thereunder, together with post 144 also help to keep the guide 133 and cord 105C in their original positions.

Figure 17:
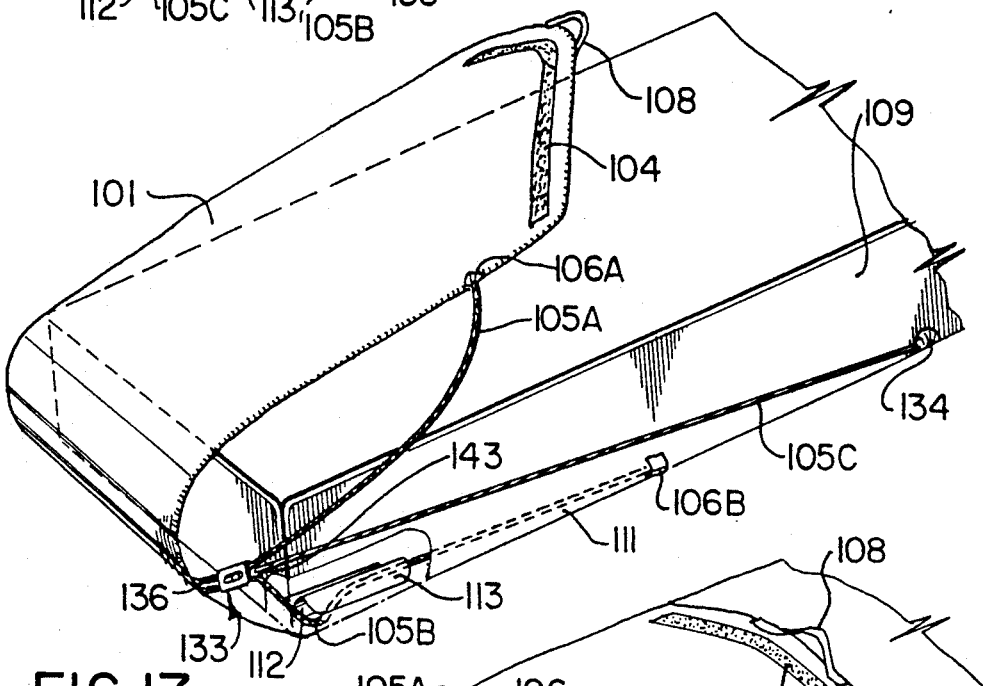
FIGS. 17 and 18 are sequential perspective partly broken away views of the device depicted in part in FIG. 16, in use.

Referring to FIG. 17, the Figure shows the device after the guide 133 has cleared the post 144 and left the pocket 102 but before the guide 133 has cleared the end of the mattress 109, drawn the cord 105B out of the groove 112 under the cover 113 and shuttled along the cords 105A and 105B. The pre-stretch cord 105C is fixedly attached to the slidable guide 133 at 143, and to the sheet 111 by stitching at 134, and extends along the lower edge of the mattress 109. The upper cord 105A is fixedly attached to the top cover 101 by stitching at 136 and at 106A and extends between 106A and 136 through the slidable guide 133. The stitching 136 is preferably mid-way between the top and base of the mattress 109 at an area along the edge of the top cover 101 where the top cover 101 ultimately covers the end face of the mattress 109. The lower cord 105B is fixedly attached to the sheet 111 at 106B, extends through guide groove 112 (under cover 113) and through slidable guide 133 and is fixedly attached to top cover 101 by stitching at 136. Once the handle 108 has been grasped and pulled a sufficient distance, the slidable guide 133, and most of the top cover 101, are drawn out of the pocket 102. When that occurs, the guide 133 rotates about the post 144. The guide 133 is then substantially free to draw together cords 105A and 105B, in a zipper-like fashion, using the energy stored in the cord 105C.

Figure 18:
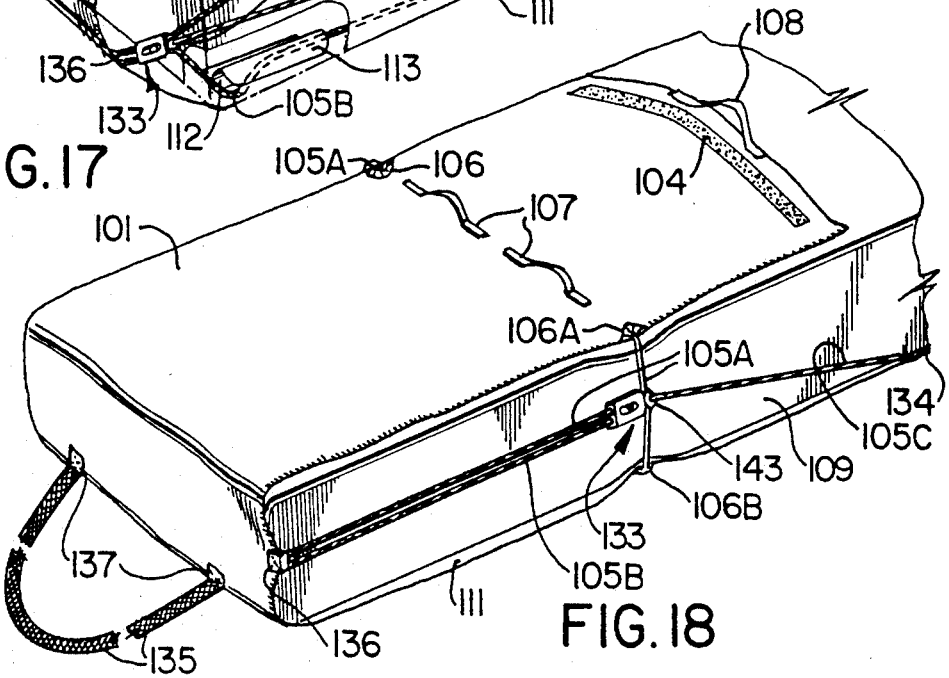

FIG. 18 shows the mattress 109 finally secured between the top cover 101 and sheet 111 by the advancement, under the energy stored in the cord 105C, of the guide 133 and cords 105A and 105B. The cord 105C has, as a result of such advancement, correspondingly shortened but preferably still applies force to the guide 133 to secure the top cover 101.

The device and mattress 109 can then be slid to the floor by pulling on the handles 107. Once on the floor, the device and mattress 109 can be moved by pulling the handle 135. The handle 135 is attached to the top cover 101 or sheet 111 near the base of the end of the mattress 109 by stitching 137.

Figure 19:
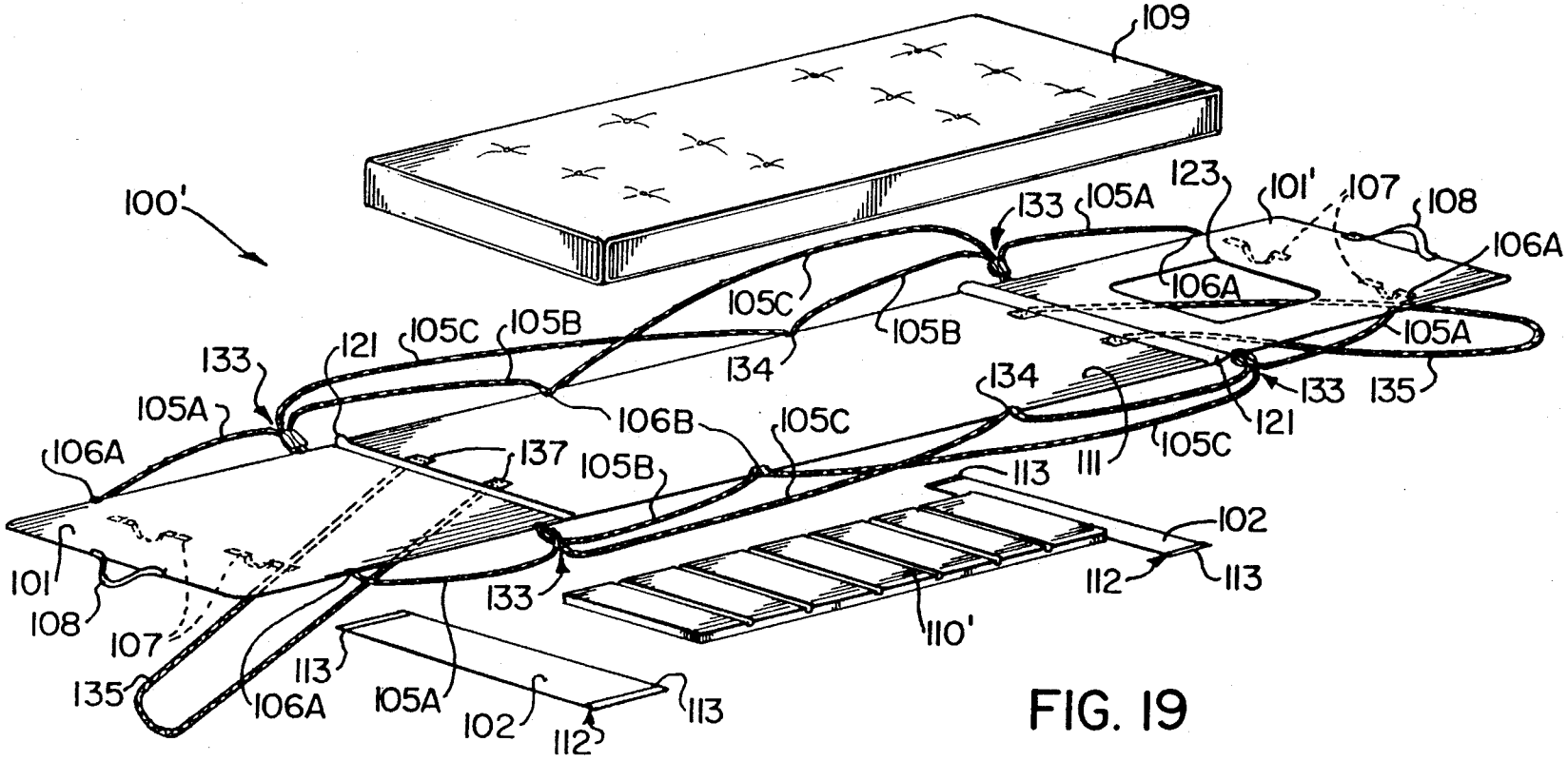
FIG. 19 is an exploded perspective view of the device shown in FIGS. 16, 17 and 18.

Referring to FIG. 19, it is preferred that the areas of attachment 106B of the lower cords 105B from one end of the device 100' are also the areas of attachment for the cords 105C from the opposite end of the device 100'. The Figure also shows that, unlike the embodiment shown in FIGS. 1 to 15, in this alternative embodiment not only is a sled 110 not necessary in tightening the covers 101 and 101' but unlike cords 105 the cords 105A, 105B and 105C do not run through a sled 110. The pockets 102 are attached to the sheet 111 as in the previous embodiment. To keep the cords 105B and 105C out of the way of bed clothes, such as sheets and blankets, the cords 105B and 105C may run under the sheet 111 in a reinforced lip adjacent to, and under the edge of, the sheet 111. For the sake of clarity that lip is not shown in the drawings.

If a sled is to be included in the embodiment shown in FIG. 19 such a sled can be a sled 110' fastened to the lower face of sheet 111. Such a sled 110' can be the sled 110 described above but need not include guide grooves 115 or the cleat assembly shown in FIGS. 12 and 13.

Figure 20:
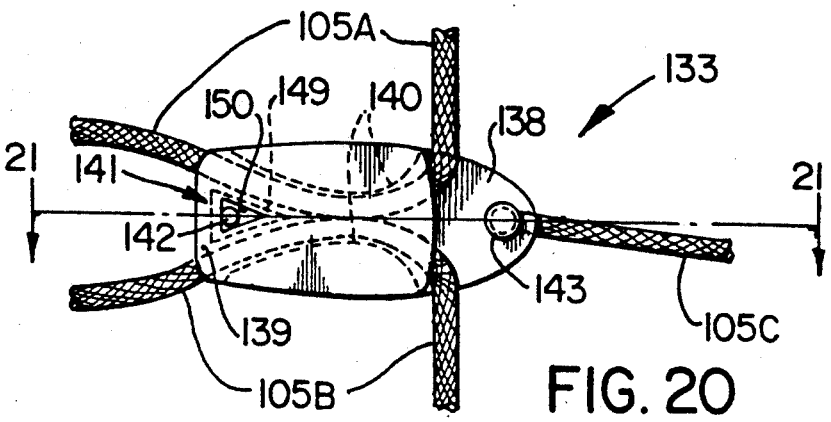
FIG. 20 is a side detail view of part of the device shown in FIGS. 17 and 18.
Figure 21:
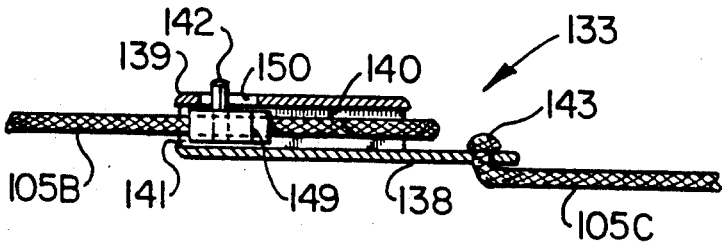
FIG. 21 is a cross-sectional view along the line C—C in FIG. 20.

Referring to FIGS. 20 and 21, the guide 133 comprises a base 138 to which the cord 105C is attached at one end at 143. A cover 139 extends over most of the remainder of the base 138. Within the cover 139 are channel walls 140 running along the length of the guide 133. The cords 105A and 105B enter the guide 133, near the attachment 143, via the gap between the channel walls 140. The cords 105A and 105B tend not to tangle but rather to stay next to the channel walls 140 as a result of (i) small clearance between the bottom of the cover 139 and the top of the cords 105A and 105B, (ii) the preferred converging arcuate perimeters of the channel walls 140 and (iii) a wedge shaped cleat 141. The cleat 141 narrows in the direction of travel of the guide 133 i.e. in the direction the guide 133 travels along the edge of the mattress 109 as the cover 101 is being secured. The cleat 141 preferably has teeth 149 to bite the cords 105A and 105B if force is applied to the guide 133 that would tend to direct the guide 133 back along cords 105A and 105B to the starting position of the guide 133. However, it is also preferred that the cleat 141 is positionable in an opening 150 in the cover 139. Preferably, the opening 150 is near the trailing end of the guide 133. A pin 142 extends from the cleat 141 through the opening 150. By grasping the pin 142 and pulling the cleat 141 in the direction opposite to the ordinary direction of travel of the guide 133 the teeth 149 can be sufficiently distanced from the cords 105A and 105B to allow the guide 133 to be drawn back along the cords 105A and 105B, restretching the cord 105C, and allowing for the evacuee to exit the device and for the device to be reused.

Figure 22:
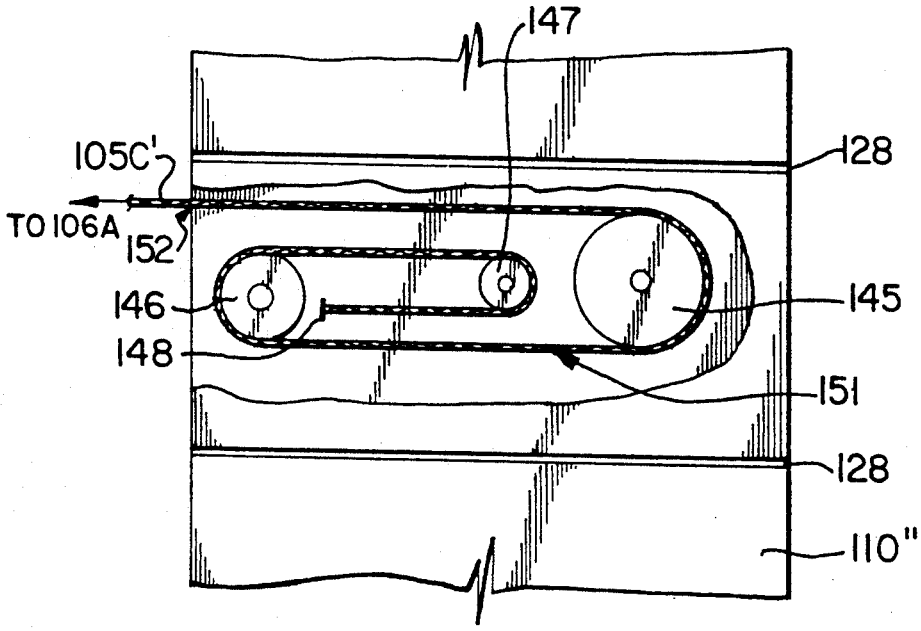
FIG. 22 is a plan detail view partly broken away of a segment of a sled for use in the present invention.

In a still further embodiment, the pre-stretched cord of the first alternative embodiment runs through a sled. In this further embodiment it is preferred that the pre-stretched cord not run the length of the sled. With transverse segmentations (such as 128 in FIGS. 14 and 15) the cord would tend to force the sled to curve upwardly at its ends. Rather, as shown in FIG. 22 it is preferred that the elastic cord 105C' be stretched within a single segment of the sled 110''. In this embodiment, the cord 105C' is fixedly attached to the sled 110'' at anchorage 148 and extends along groove 151. From attachment 148 the cord 105C' extends to and bears first on pulley 147, then extends to and bears on pulley 146 and finally extends to and bears on pulley 145 before exiting from the sled 110'' at 152. The cord 105C' then extends to attachment 106A on top cover 101. The cord 105C' is kept stretched, preferably by being secured by a latch (not shown), which is opened by drawing the tip cover 101 out of the pocket 102.

A further and preferred embodiment, in which a sled is not required, will now be described with reference to FIGS. 23 to 30.

As in the embodiments described above, such as FIG. 19, the top covers 101 and 101' are drawn out of respective pouches 102 by pulling on handles 108 and 108' attached to the respective top covers 101 and 101'. The configuration of the device before that occurs will now be described, with reference to FIG. 23.

Figure 23:
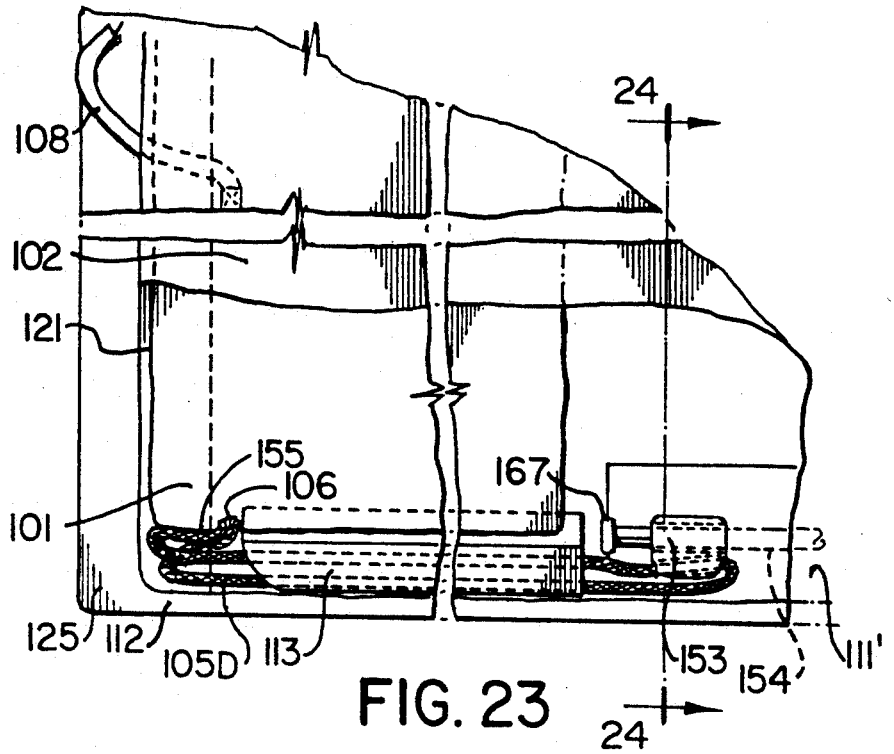
FIG. 23 is a partial plan view of an alternative arrangement to that shown in FIG. 16.

Referring to FIG. 23, there is shown a sheet 111' including pouches 102 having lids 121, grooves 112 and groove coverings 113, for use on a bed frame 125 as described above. The sheet 111' further comprises a lip 154 spanning a substantial length of each long edge of the sheet 111', beginning at the backs of the pockets 102. A cleat 153 slidably engages the lip 154 which preferably has a thickened portion 167 at each end to stop the cleat 153 from sliding off either end of the lip 154. A looped cord 105D extends through the cleat 153. The looped cord 105D passes through the cleat 153 and extends along the grooves 112, under the covers 113 and is respectively attached to the cover sheet 101 at connection points 106 and 155 inside the pockets 102.

Figure 24:
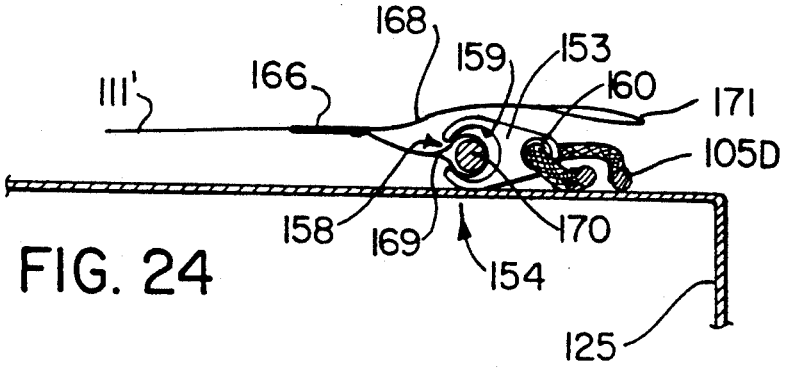
FIG. 24 is a cross-sectional view along the line D—D in FIG. 23.

Referring to FIG. 24, lip 154 is formed by a cord 170 tightly enclosed in a hem of the edge of the sheet 111' by stitching 169. The lip 154 is parallel, and adjacent, to each long edge of the sheet 111'. Near the side edges of the back of each pocket 102 the lip 154 and the edge of the sheet 111' are covered by a flap 168 to keep the cleat 153 and lip 154 out of the way of bed clothes such as sheets and blankets. One edge of the flap 168 is secured to the sheet 111' by stitching 166 and the other edge has a hem 171.

Figure 25:
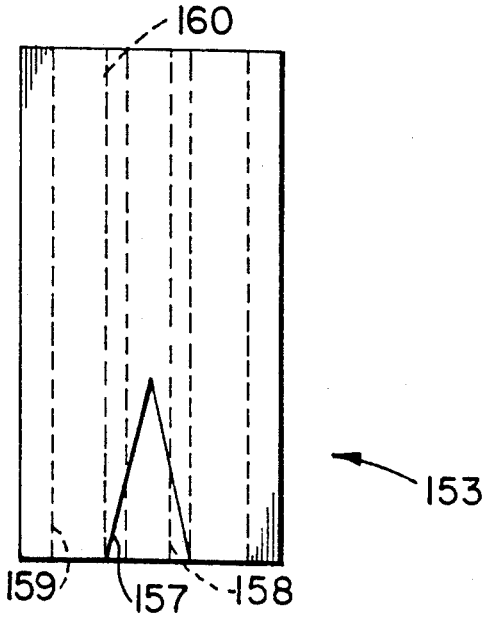
FIG. 25 is a detailed plan view of the cleat shown in FIGS. 23 and 24.

Referring also to FIG. 25, the cleat 153 is tubular and has a C-shaped transverse cross-section. Along the full length of its base an opening 158 extends. The opening 158 communicates along its length with a passage 159 which also runs the full length of the cleat 153. The passage 159 is substantially the shape as, but larger than, the lip 154.

The cleat 153 and lip 154 are made of material that is sufficiently flexible to allow the lip 154 to be pushed through the opening 158 into the passage 159.

Above the passage 159 and also extending the full length of the cleat 153 is a passage 160. The passage 160 has a large enough cross-section to allow the cord 105D to travel through it.

Figure 26:
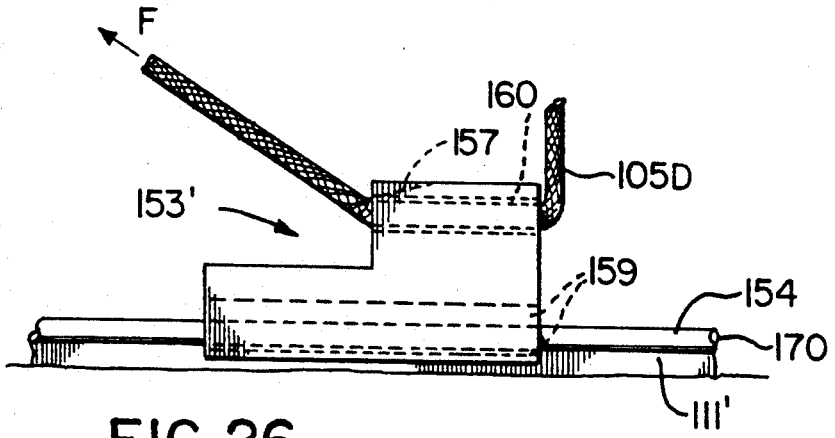
FIG. 26 is a side view of an alternative cleat to that shown in FIG. 25.

At one end of the passage 160 a notch 157 extends from that end of the passage 160 towards the top of the middle of the cleat 153, as best shown in FIGS. 25 and 26. Referring to FIG. 26, the notch 157 narrows toward the middle of the top of the cleat 153. That narrowing provides a way to secure the cleat 153 to the cord 105D. By pulling upwardly on the portion of the cord 105D extending out of the wide end of the notch 157, the cord 105D is wedged in the notch 157.

Care should be taken to balance the flexibility of the lip 154, cleat 153 and cord 105D to ensure that the notch 157 can bite and hold the cord 105D without the cleat 153 popping off the lip 154.

Referring to FIG. 26, the upper portion of a variant cleat 153' is not as long as the lower portion of the variant cleat 153'. As a result, the passage 160' in the cleat 153' is relatively shorter than the passage 160 in the cleat 153. As well, the distance between the narrow end of the notch 157 and the opposite end of the upper portion of the cleat 153' is shorter than the corresponding distance on the cleat 153. With the cleat 153' a larger force F can be applied to the cord 105D to make the notch 157 bite and hold the cord 105D with less likelihood of the cleat popping off the lip 154.

Figure 27:
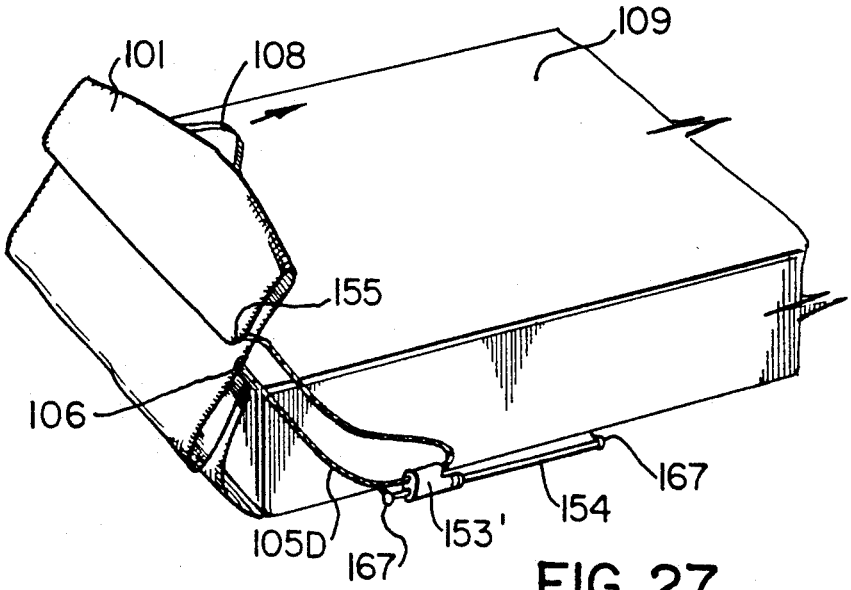
FIGS. 27, 28, 29 and 30 are sequential perspective views illustrating the securement of a sheet to a mattress.

In FIGS. 27 to 30 the flap 168 is omitted for the purposes of clarity. Referring to FIG. 27, the handle 108 in this embodiment is not attached to the loose end of the top cover 101 but rather is attached to the underside of it by sewing approximately 30 cm from that end. Approximately 30 cm of the top cover 101 doubles back from the handle 108 over top of the rest of the top cover 101. The cord 105D is attached, by sewing, to the top cover 101 at points 106 and 155, 106 being approximately 60 cm from the loose end of the top cover 101 and 155 being near that end. The portion of the cord 105D attached at 155 extends out of the notched end of the passage 160 and then doubles back to attach at 155. The portion of the cord 105D attached at 106 extends out of the other end of the passage 160, directly to attachment 106.

Figure 28:
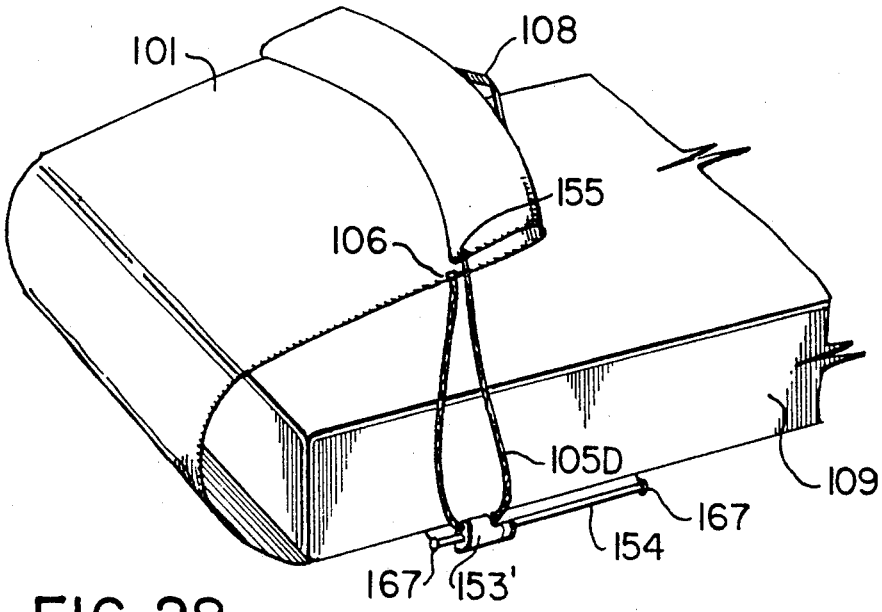

Referring to FIG. 28, as the sheet 101 is drawn out still further by pulling on handle 108 the cleat 153' moves toward the middle of the lower edge of the mattress 109, along the lip 154.

Figure 29:
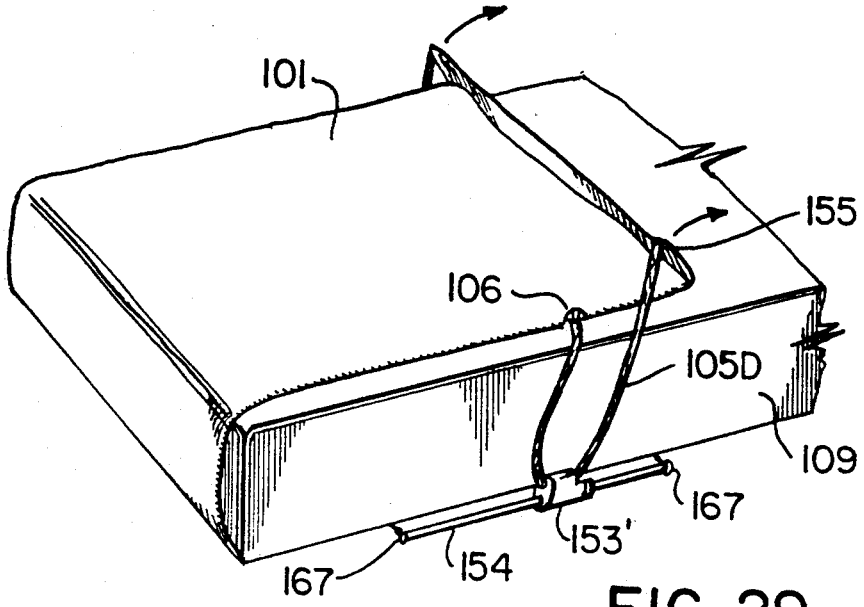

Referring to FIG. 29, once the top cover 101 is fully drawn out of the pocket 102 the cleat 153' has travelled a substantial distance along the lip 154. The portion of the top cover 101 folded over the remainder of the top cover 101 is unfolded, by grasping the corners of the loose end of the top cover 101, and the last 30 cm or so of the top cover 101 are advanced in the direction of the arrows towards the opposite end of the mattress 109.

Figure 30:
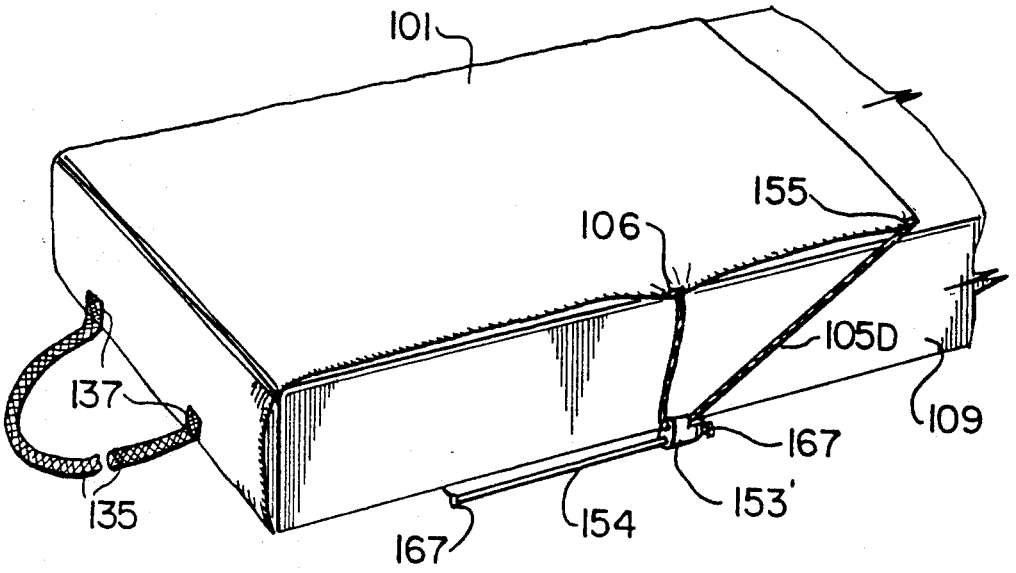

Referring to FIG. 30, the steps depicted in FIGS. 27, 28 and especially 29, have resulted in the cleat 153' advancing substantially the full length of the lip 154. In so doing the portion of the cord 105D between the attachment 155 and the cleat 153' has lengthened at the expense of the portion between the cleat 153' and the attachment 106, which has shortened. The top cover 101 has been drawn towards the mattress 109 and sheet 111'.

A further aspect of the invention combines aspects of the embodiment depicted in FIGS. 28 to 30 with aspects of the embodiment depicted in FIGS. 17 to 21. This further aspect of the invention will now be described with reference to FIGS. 31 to 33.

Figure 31:
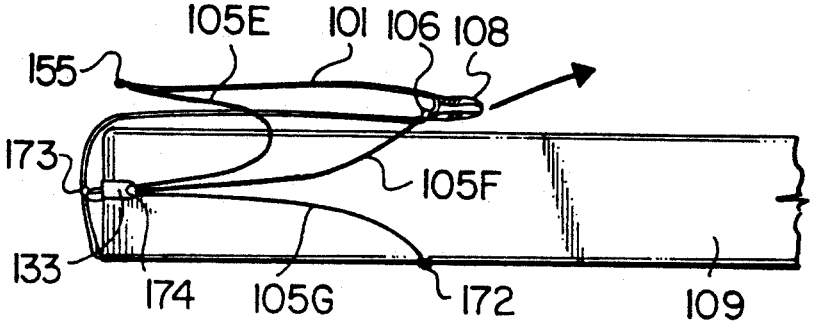
FIGS. 31, 32 and 33 are sequential side views illustrating the securement of a sheet to a mattress.

Referring to FIG. 31, the Figure shows the device once the top cover 101 has begun to be drawn out from under the mattress 109. The handle 108 on the top cover 101 is attached to the underside of the top cover 101, by sewing, approximately 30 cm from the free end of the top cover 101. Approximately 30 cm of the top cover 101 doubles back from the handle 108 over top of the rest of the top cover 101. A cord 105F is attached to the edges of the top cover 101, by sewing, at points 106 and 173, 173 being along the edge of the top cover 101 approximately 60 cm from the free end of the top cover 101 and 106 being approximately 30 cm from that end. A cord 105G is attached to the edge of a sheet 111 by stitching 172 approximately 30 cm from the end of the mattress 109. The cord 105G is also attached to the top cover 101 by stitching 173. The cords 105F and 105G run through a guide 133 in a manner similar to the cords 105A and 105B depicted in FIGS. 20 and 21. A cord 105E is attached to the edge of the free end of the top cover 101 by stitching 155 and to the leading end of the cleat 133 by clip 174.

Figure 32:
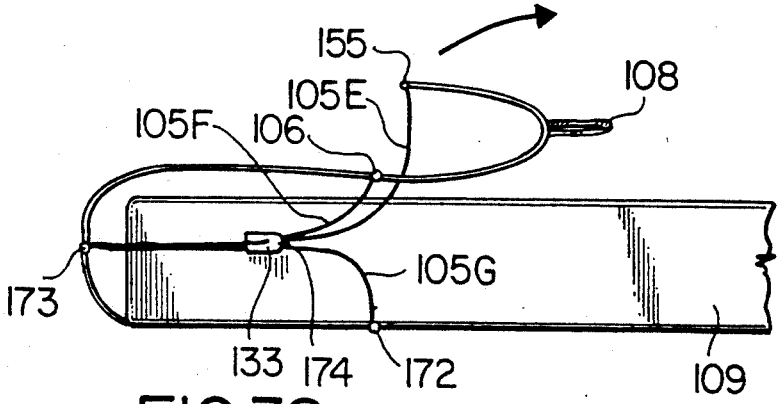

Referring to FIG. 32, as the top cover 101 is drawn out still further by pulling on handle 108 the guide 133 moves in the same direction along the cords 105F and 105G.

Figure 33:
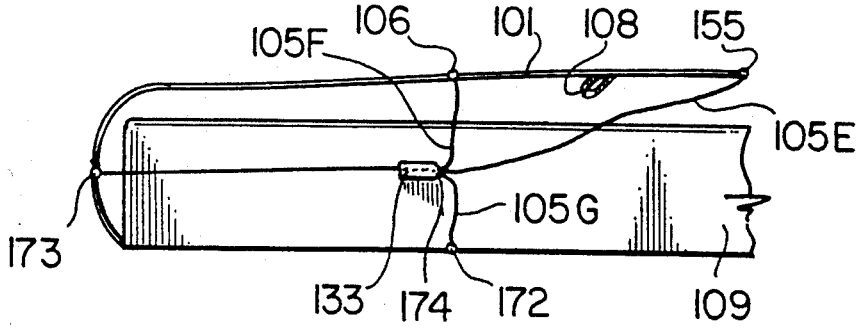

Referring to FIG. 33, once the top cover 101 is fully drawn out, the folded portion of it is unfolded to fully tighten the cords 105E, 105F and 105G and the guide 133 has travelled a substantial distance along the cords 105F and 105G.

In the alternative to the above-described preferred embodiments, the person 103 is covered by a single top cover sheet 101 made of flexible material. The single sheet is drawn out from side to side across the mattress 109 or sled 110 or from one end of the mattress 109 or sled 110 towards the other end of the mattress 109 or sled 110.

To force such a sheet 101, or a plurality of sheets 101, against the mattress 109 or sled 110 at least one first clasp, at least one second clasp and at least one third clasp may be used. The first clasp secures the sheet 101 to the mattress 109 or sled 110 or a sheet 111, with the result that the sheet 101 is dispensable to cover a substantial portion of the person 103 and of the upper surface of the mattress 109 or sled 110 or sheet 111. The second clasp is accordingly secured to the mattress 109 or to the at sled 110 or sheet 111, depending on whether the first clasp is secured to the mattress 109 or to the sled 110 or sheet 111. The third clasp is engageable with the second clasp to enclose the person 103 between the cover sheet 101 and, as the case may be, the mattress 109 or the sled 110 or sheet 111. In either event, the first clasp may be replaced by stitching and the second clasp may be a clip attached to the mattress 109 and specially adapted to engage the third clasp.

An improvement on the above described invention will now be described in detail with reference to FIGS. 34 to 43.

Figure 34:
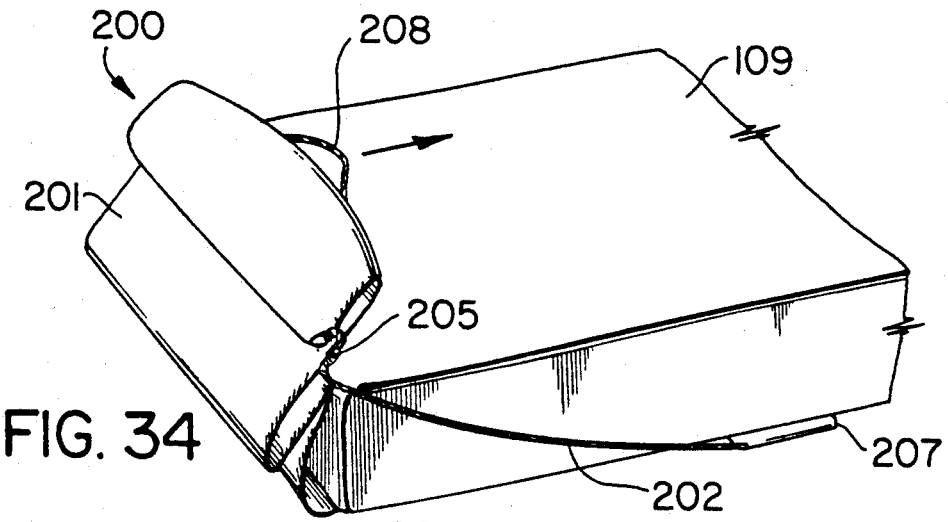
FIGS. 34, 35 and 36 are sequential perspective views showing deployment of an evacuation device according to an improvement on the invention shown in the previous figures.

Referring to FIG. 34, the improved device 200 is initially placed under the mattress 109 which supports the person 103 on the bed 125 as shown in FIG. 1. A portion of a flexible sheet 201 is accordion folded under a corresponding end of the mattress 109. (For brevity and clarity this detailed description largely refers to one side and one end of the bed, i.e. single sheets, single cords, single cleats and single handles. It should be understood, however, that it is preferred that the device 200 be substantially symmetric on either side of the mattress 109. It will also be understood that except for a hole in the sheet, for the person's head, it is also preferred that the device 200 be symmetric at the foot- and head-ends of the mattress 109, i.e. that it comprises either one sheet under the mattress emerging at the foot- and head-ends or two sheets similar to the sheet 201 which are joined together below the lower face of the mattress 109 and which is use fasten to one another above the upper face of the mattress 109. Similarly, it should be understood that there are preferably two handles on each long edge of the device.) The device 200 further consists of two cords 202 and 203, two cleats 204 (not shown) and 205 and two slotted handles 206 (not shown) and 207.

Figure 35:
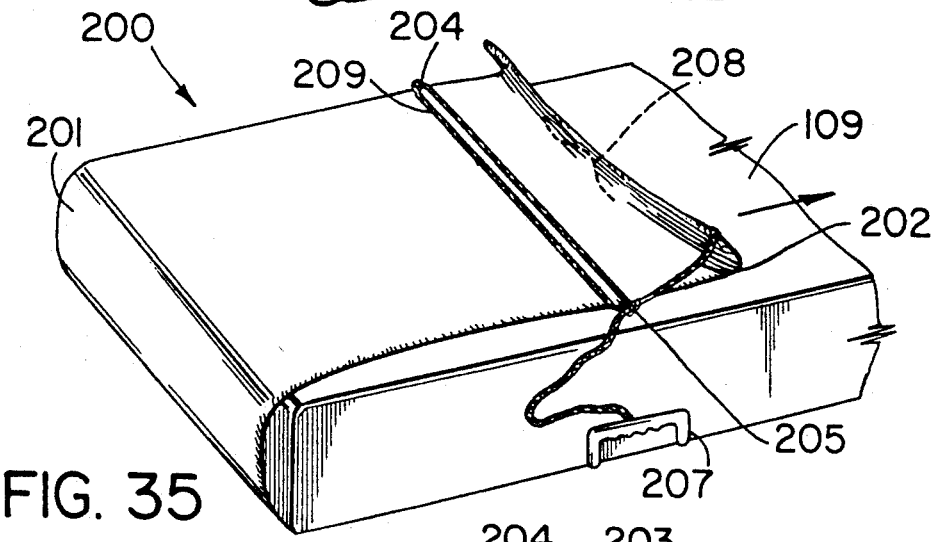
Figure 36:
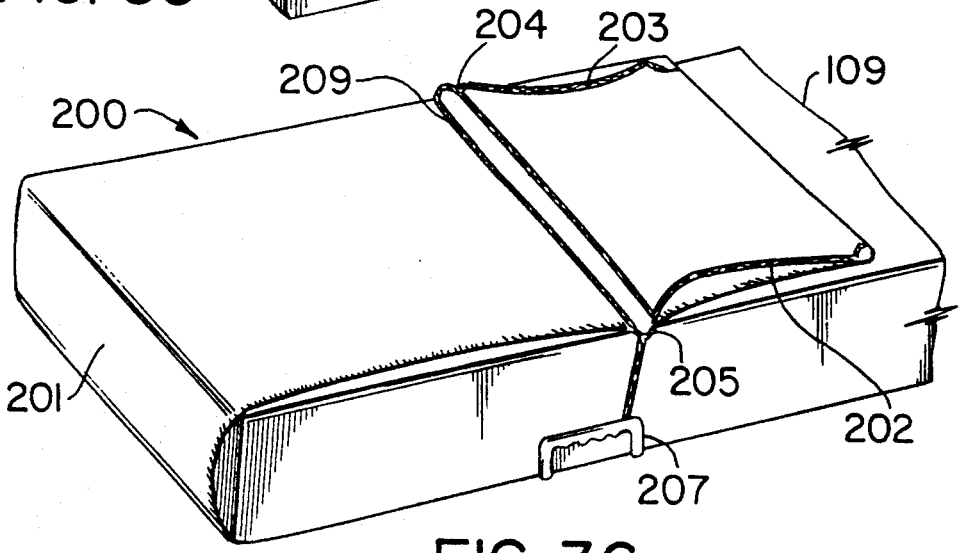

In use, by grasping the handle 208 the accordion folded portion of the sheet 201 is pulled towards, and then up and over the closest end of the mattress 109, such that the sheet 201 can then be pulled over the mattress 109 and over the person laying on that mattress 109. An aspect of the folding of the sheet 201 is that a last fold remains once the sheet 201 has been pulled over the person on the mattress 109 (FIG. 35). By then grasping the free end of the sheet 201 and pulling it towards the far end of the mattress 109 much of the length of each cord 202 and 203 passes through its respective cleat 204 and 205; the lower end of each cord 202 and 203 is movably secured to a respective handle 209 (not shown) and 210; and, as a result, the person is securely enclosed between the sheet 201 and the mattress 109 (FIG. 36). The handles 206 (not shown) and 207 can then be grasped to remove the mattress 109, with the person 103 secured to it, from the bed 125.

The sheet 201 is preferably made of vinyl reinforced with polyester. STAPH CHECK 20 TM is such a material. The sheet 201 is approximately the size of the lower face of the mattress 109 with which it is to be used. (Of course, if a single sheet is used, rather than two joined sheets, then its length should be approximately twice that of the mattress.) Before being used the sheet 201 sits below approximately half of the lower face of the mattress 109. The part of the sheet 201 that is below an end of that mattress 109 is arranged in an accordion folded manner.

Pulling on the handle 208 tends to pull the edges of the sheet 201 away from the edges of the mattress 109. A batten 209 is attached to the cleats 204 and 205. The batten 209 is preferably a semi-rigid plastic strip approximately $\frac{1}{8}$ of an inch thick and $1\frac{1}{2}$ inches wide. The batten 209 helps keep the sheet 201 at full width while the handle 208 is pulled.

Figure 37:
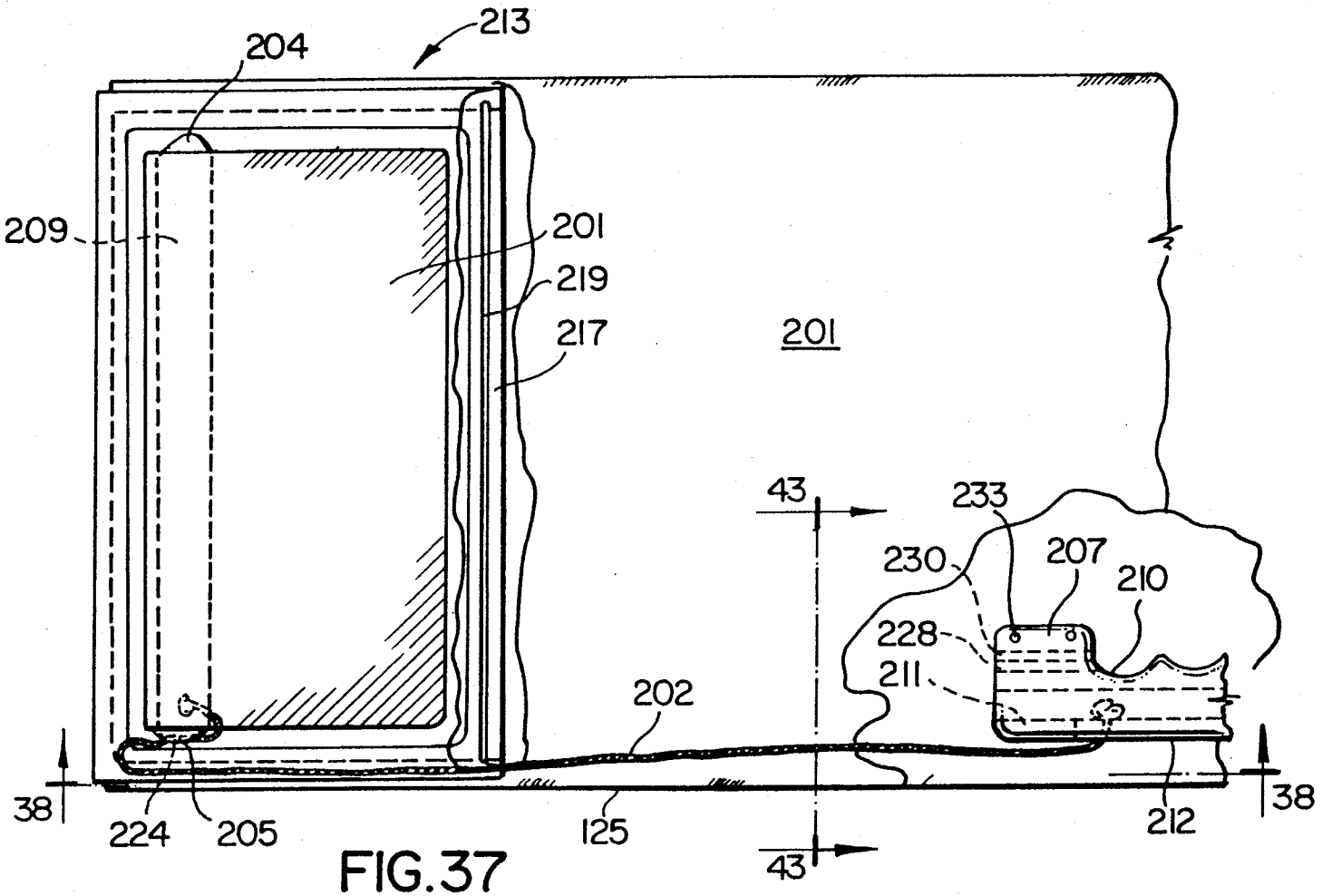
FIG. 37 is a partially broken away plan view of the evacuation device shown in FIGS. 34, 35 and 36 with pouch cover and mattress omitted.
Figure 41:
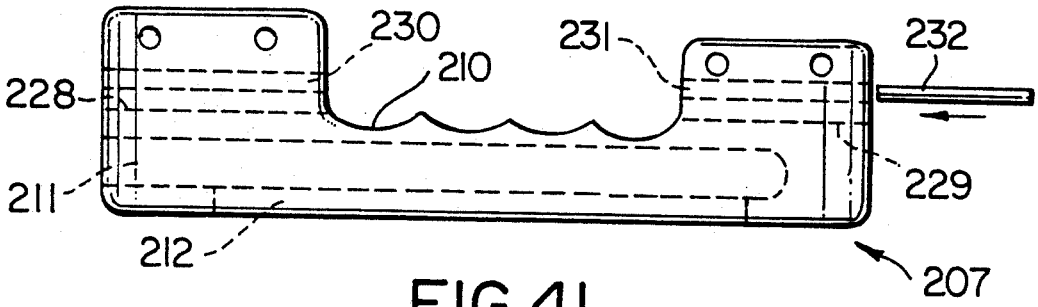
FIG. 41 is a plan view of the handle shown in FIG. 40.
Figure 42:
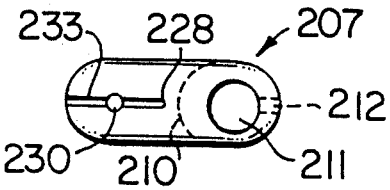
FIG. 42 is an end view of the handle shown in FIG. 40.
Figure 43:
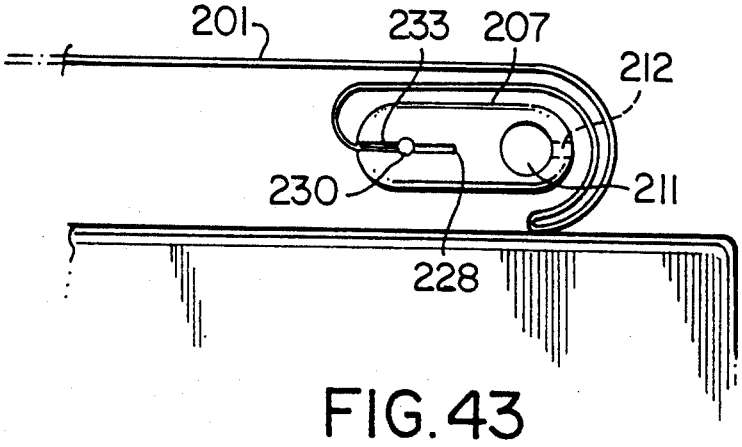
FIG. 43 is a cross-sectional end view along the line G—G′ in FIG. 37.

Referring to FIGS. 37 and 41, the slotted handle 207 is generally C-shaped, preferably made of injection molded plastic, approximately 7 inches long and includes hand grips 210. It is attached and parallel to a respective lower side of the sheet 201, such that when the device 200 is positioned for use the handle 207 will be approximately 20 inches from the end of the mattress 109. A bore 211 in the slotted handle 207 is parallel to its longitudinal axis. The bore 211 extends completely to one end of the slotted handle 207 and the diameter of the bore 211 is greater than the diameter of the respective cord 202 with which it is to be used. An opening 212 extends from the base of the handle 207 to the bore 211. The width of the opening 212 is greater than the diameter of the cord 202 and less than the diameter of the bore 211.

It is preferred that the handle 207 be attached to the sheet 201 a few inches from its edge so that, towards the end of pulling action of the cord 202, the handle 207 is pulled out from under the mattress 109 and the lower portion of the sheet 201. Attaching the handle 207 at that location keeps the handle under the sheet 201 and out of the way of bedding and of the bed 125 until the device 200 is being deployed. Setting the handle 207 back from the edge of the sheet 201 also facilitates the cord 202 clearing the corner of the mattress 109 as the sheet 201 is drawn out of the pouch 213.

The cleat 205 is an injection molded plastic tube fixed to a respective side edge of the sheet 201 approximately 60 inches closer to the end of the sheet 201 than is the corresponding slotted handle 207 as measured along the sheet 201. A longitudinal opening in each cleat 205 runs the length thereof and is large enough for the cord 202, with which it is to be used, to move through the opening. The cleat may be of the same general shape as the cleat depicted in FIG. 25. Other suitable cleats may, of course, be used.

The cord 202 is preferably ⅛ of an inch in diameter and made of high tensile strength material. An upper end of the cord 202 is stitched to a corresponding corner of the sheet 201. The other end of the cord 202 is then run through the longitudinal opening of the corresponding cleat 205, inserted into the opening 212 of the corresponding slotted handle 207 and run along and out the end of the bore 211 and secured against withdrawal from the opening 212 and bore 211. Suitably, withdrawal may be prevented by heating the inserted end until it is malleable, and then, while it is still malleable, thickening and flattening it so that its diameter is greater than the width of the slot 212 of that slotted handle 207 but not larger than the bore 211. Alternatively a nut can be secured to the inserted end of the cord 202 to prevent withdrawal. As a result of the above described structure the lower ends of the cords 202 and 203 are movably fixed in the bores 215 and 211 of respective slotted handles 206 and 207 near the bottom outside edges of the sheet 201 and mattress 109.

Figure 38:
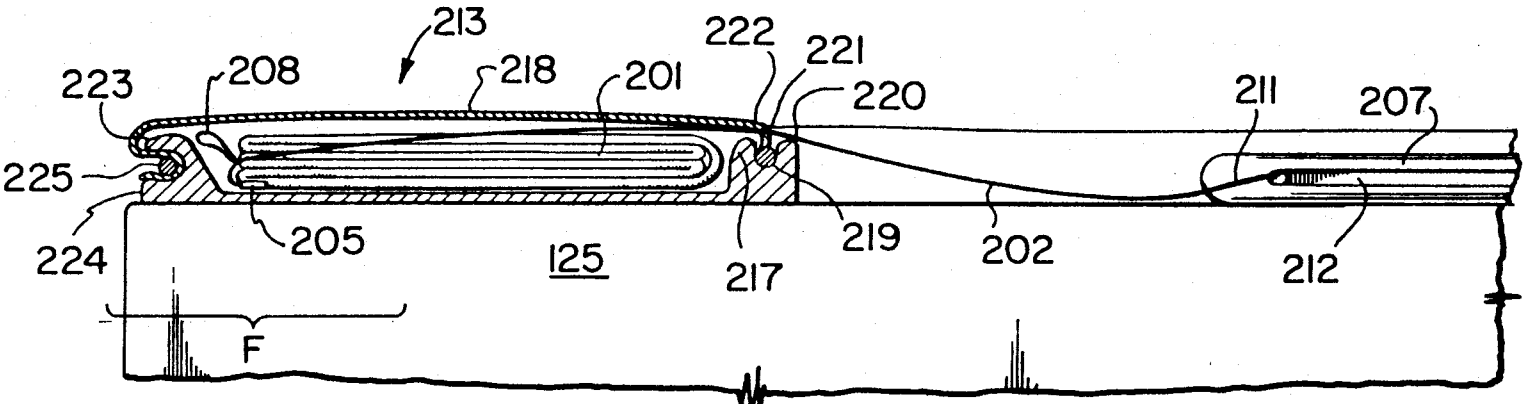
FIG. 38 is a cross-sectional side view along the line E—E′ shown in FIG. 37, with the pouch cover in place.

Referring to FIG. 38, before use the sheet 201 is folded into a tray-like pouch 213. Preferably, the pouch 213 is, from top to bottom, approximately ½ inch thick and is made of injection molded plastic. Along an upper face 217, of the pouch 213, farthest from the end of the mattress 109, the sheet 201 passes between the top of the pouch 213 and the bottom face of a pouch cover 218. In that region the pouch cover 218 is sewn to the top face of the sheet 201.

Near the face 217 a groove 219 in the pouch 213 runs substantially the length of the face 217. An edge 220 of a strip 221 of STAPH CHECK 20 TM is sew to the bottom face of the sheet 201 parallel to the groove 219. The strip 221 is then puckered to form a ridge of material that will snap into the groove 219. The other edge 222 of the strip 221 is then also sewn to the bottom face of the sheet 201, taking care to preserve the required pucker of the strip 221. As an alternative to the strip 221 a cord made of squeezable material may be used to form the ridge of material that will snap into the groove 219.

Figure 39:
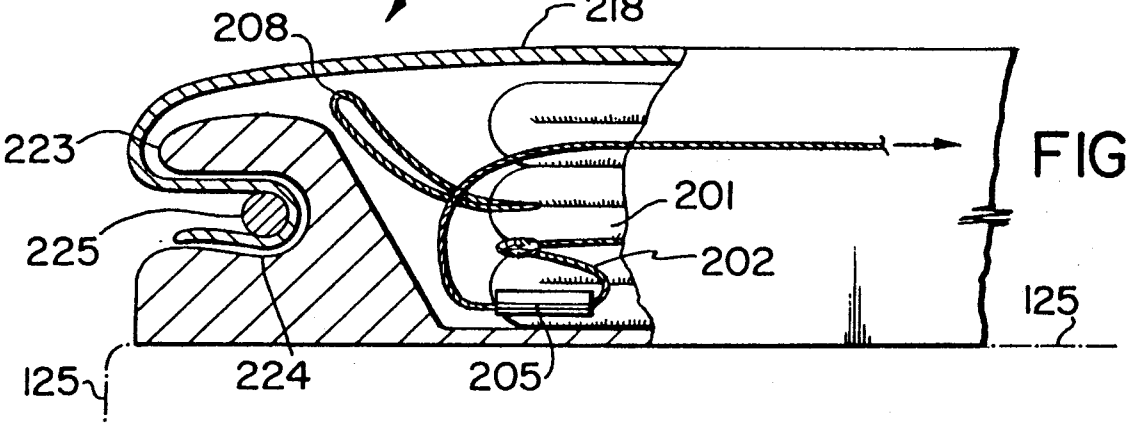
FIG. 39 is a side view of a detail of the portion F of the device shown in FIG. 38.
Figure 40:
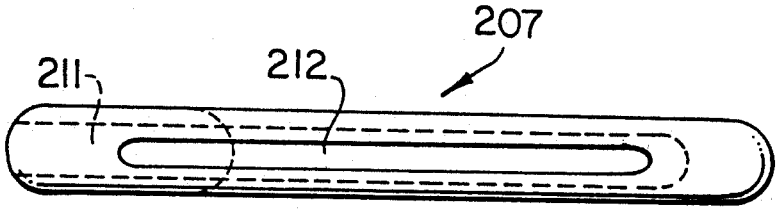
FIG. 40 is a side view of a handle that is part of the device shown in FIGS. 34 to 39.

Referring to FIG. 39, the front face 223 of the pouch 213 includes a groove 224 running for substantially the length of the face 223. The cover 218 extends over the accordion folded portion of the sheet 201 and over the face 223. The cover 218 overlaps enough of the front face 223 that a 3/16 inch diameter rip cord 225 can be laid against the portion of the cover 218 that extends over the groove 224 and, together with that portion of the cover 218, snapped into the groove 224. The groove 224 extends around the sides of the pocket 213. Snapping the puckered strip 221 into the groove 217, together with snapping the rip cord 225 and cover 218 into the groove 224, keeps the accordion folded portion of the sheet 201 largely sealed away from dirt and out of the way of bed clothes such as blankets and mattress covers.

The pouch 213 should be positioned close enough to the end of the mattress 109 that the rip cord 225 can readily be grasped and pulled. The sheet 201 should be so folded in the pouch 213 that by pulling the rip cord 225 a looped cord handle 208 attached one fold back from the end of the sheet 201 will be exposed so that it can be grasped to pull the sheet 201 out of the pocket 213 and over the person who is on the mattress 109. The pouch 213 can then be snapped off of the puckered strip 221. Stability of the device 200 before use, and removal of the pouch 213 from the device 200 during use, are facilitated by the pouch 213 having been attached to the bed 125, suitably by means of complimentary hook and loop fastening material, such as VELCRO TM.

The manner of attaching the handle 207 to the sheet 201 and stowing the attached handle 207 will now be described with reference to FIGS. 40 through 43. In the region of handle 207 the width of the sheet 201 is sufficient to allow the handle 207 to lay on the bed 125 and for the sheet 201 to overlap and cover the handle 207. (See FIG. 43.) About an inch of the edge of the sheet 201 is folded to produce a hem-like feature (not shown.) The hem-like feature is then inserted into the slot-like openings 228 and 229 in the handle 207. The slots 228, 229 are widened over part of their extent, as at 230 and 231, to allow a dowel 232 to be inserted into the widened portion 231, between the closed end of the hem-like feature and the open end of the hem-like feature. Together with screws (not shown) screwed into holes 233 in the handle 207, the dowel 232 serves to secure the handle 207 to the sheet 201.

It should be understood that variations on the above-described improvement are possible. For example, the sheet 201 may be attached to the mattress 109, as may the handles 207, particularly if the device 200 does not include pouch 213.

The embodiments of the invention in which an exclusive property or privilege is claimed are defined as follows:

1. An evacuation device for a non-ambulatory person lying on a mattress on a bed, comprising:
   - covering means deployable over said person's head for covering said person;
   - handle means, including a cord, attached to said covering means;
   - enclosing means attached to said covering means; and
   - securement means, engaging said enclosing means, for securely enclosing said person between said covering means and said securement and for guiding and facilitating said cord to move past a corner of said mattress when said cord is pulled.

2. An evacuation device for a non-ambulatory person lying on a mattress on a bed, comprising:
   - sheet means, stored proximal to a head end of said mattress when not in use, for enclosing said person once said person is positioned between said mattress and said sheet means;

securement means for forcing said sheet means against said mattress;

means for placement beneath said mattress for supporting and moving said device on a surface; and wherein said sheet means comprises at least one sheet of flexible material and said securement means comprises at least one first securement member, at least one second securement member, and at least one third securement member, said first member securing said sheet means to said mattress such that said sheet means is deployable so as to cover a substantial portion of said person and of the upper surface of said mattress, said second member being secured underneath said mattress, and said third member being engageable with said second member to enclose said person between said mattress and said sheet means.

3. An evacuation device for a non-ambulatory person lying on a mattress on a bed, comprising:

sheet means, stored proximal to a head end of said mattress when not in use, for enclosing said person once said person is positioned between said mattress and said sheet means;

securement means for forcing said sheet means against said mattress; and means for placement beneath said mattress for supporting and moving said device on a surface;

wherein said sheet means comprises at least one sheet of flexible material and said securement means comprises at least one first securement member, at least one second securement member and at least one third securement member, said first member securing said sheet means to said moving means such that said sheet means is deployable so as to cover a substantial portion of said person and of the upper surface of said moving means, said second member being secured to said moving means, and said third member being engageable with said second member to enclose said person between said supporting and moving means and said sheet means.

4. The device as claimed in claim 3, wherein at least part of said sheet means is stored by accordion type folding of said at least part of said sheet means.

5. The device as claimed in claim 4, wherein said at least part of said sheet means is stored under said mattress.

6. The device as claimed in any one of claims 3, 4, or 5, wherein said supporting and moving means comprises at least one sheet of low friction flexible material covering at least part of a lower surface of said mattress.

7. The device as claimed in claim 6, wherein said low friction material includes polytetrafluoroethylene.

8. The device as claimed in any one of claims 3, 4, or 5, wherein said supporting and moving means comprises rolling means and means for mounting said rolling means to said device.

9. The device as claimed in claim 8, wherein said rolling means comprises a plurality of wheel-axle assemblies.

10. The device as claimed in claim 8, wherein said mounting means comprises at least one sheet of rigid material having in a lower surface thereof a plurality of wheel-axle assemblies.

11. The device as claimed in claim 10, wherein said at least one sheet of rigid material is segmented to facilitate said at least one sheet conforming to the shape of said mattress.

12. The device as claimed in claim 11, wherein said at least one sheet of rigid material includes injection molded plastic.

13. The device as claimed in claim 9, wherein said wheel-axle assemblies include nylon wheels.

14. The device as claimed in any one of claims 3, 4, or 5, wherein said supporting and moving means further comprises braking means.

15. The device as claimed in claim 14, wherein said supporting and moving means further comprises a sheet of rigid material and said braking means further comprises an area of high friction material mount on a lower surface thereof.

16. An evacuation device for a non-ambulatory person lying on a mattress on a bed, comprising:

covering means, including a webbing, deployable over said person's head for covering said person;

handle means, including a cord, attached to said covering means;

enclosing means attached to said covering means; and securement means, engaging said enclosing means, for securely enclosing said person between said covering means and said securement and for guiding and facilitating said cord to move past a corner of said mattress when said cord is pulled.

17. An evacuation device for a non-ambulatory person lying on a mattress on a bed, comprising:

covering means, including at least one sheet of flexible material, deployable over said person's head for covering said person;

handle means, including a cord, attached to said covering means;

enclosing means attached to said covering means; and securement means, engaging said enclosing means, for securely enclosing said person between said covering means and said securement and for guiding and facilitating said cord to move past a corner of said mattress when said cord is pulled.

18. The device as claimed in any one of claims 1, 16 or 17, wherein at least part of said covering means is arranged to be stored proximally to a mattress.

19. The device as claimed in claim 18, wherein said at least part of said covering means is stored by accordion type folding of said at least part of said covering means.

20. The device as claimed in claim 19, wherein said at least part of said covering means is stored under said mattress.

21. An evacuation device for a non-ambulatory person lying on a mattress on a bed, comprising:

covering means deployable over said person's head for covering said person;

handle means, including a cord, attached to said covering means;

enclosing means attached to said covering means; and securement means, engaging said enclosing means, for securely enclosing said person between said covering means and said securement and for guiding and facilitating said cord to move past a corner of said mattress when said cord is pulled;

wherein said handle means comprises a cord and said securement means comprises guiding means for facilitating said cord to move past a mattress corner when said cord is pulled.

22. The device as claimed in claim 21, wherein said guiding means comprises at least one loop and at least one first guide groove, said loop being attached to said covering means, and said first guide groove being below said mattress corner and configured such that, upon said cord being pulled, said cord passes out of said first guide groove and out of said loop and moves toward an opposite end of said device.

23. The device as claimed in claim 22, wherein said at least one loop is located on said covering means such that in use said cord is proximal to an edge of an upper surface of a mattress.

24. The device as claimed in claim 21, wherein said guiding means comprises a plurality of loops, said loops being attached to said covering means.

25. The device as claimed in claim 24, wherein said plurality of loops is located on said covering means such that in use said cord is proximal to an edge of an upper surface of the mattress.

26. The device as claimed in claim 25, wherein said securement means further comprises tensioning means for engaging said cord below said covering means, said tensioning means comprising at least one second guide groove for passage therealong of said cord.

27. The device as claimed in claim 26, wherein said tensioning means further comprises at least one cleat engageable with said cord to maintain a tautness of said covering means against said person.

28. The device as claimed in claim 27, wherein said tensioning means further comprises stop means extending from said cord, said stop means for inhibiting movement of said cord into said second guide groove, thereby limiting the tautness of the covering means against said person.

29. The device as claimed in claim 28, wherein said securement means are located in at least one sheet of rigid material.

30. The device as claimed in claim 29, wherein said securement means includes, located in a lower surface of said securement means, means for moving said device on a surface beneath said lower surface.

31. The device as claimed in claim 30, wherein said at least one sheet of rigid material is segmented to facilitate said at least one sheet of rigid material conforming to the shape of said mattress.

32. The device as claimed in claim 31, wherein said at least one sheet of rigid material includes injection molded plastic.

33. A rescue or evacuation device for transporting a bed-ridden person, and adapted to remain under a bed mattress until needed, comprising:

a central sheet portion having approximately the size of a mattress and adapted to underlie the mattress;

a panel portion at each of the foot and head ends of the central sheet, adapted to remain folded under the mattress while not in use, and to unfold when needed to overlie the person by covering the head and foot ends of the mattress, and meet at a central part of the mattress, with means for fixing the meeting portions removably in place, whereby to form a retaining panel over the person;

said head end portion presenting an aperture for the head of the person;

strand operated means adapted to draw the retaining panel downwardly towards the central underlying sheet to tighten the retaining sheet against the mattress and retain the person securely within; and said strand operated means comprising on each side of the device a strand attached to a first anchorage point on an edge of the foot end panel intermediate a forward moving edge and an edge of a central sheet portion of the foot end panel, and passing through a guide attached to the central sheet, and terminating at a second anchorage point on the foot end panel adjacent to the forward moving edge thereof;

whereby when the foot end panel is deployed by pulling it up over the person and affixing it to the meeting portion of the head end panel the strand on each side is pulled longitudinally along the mattress, and the first and second anchorage points are drawn further apart, whereby each side edge of the central sheet is drawn towards an adjacent side edge of a retaining sheet formed by the foot and head end sheets, whereby to retain the person firmly in place against the mattress.

34. The device as in claim 33 wherein the guide attached to the central sheet is moveable along an edge thereof to facilitate the tightening of the strand during deployment.

35. The device as in claim 34 wherein the guide comprises a slotted runner adapted to move along a bead forming an edge of the central sheet, and the guide includes a passage for the strand to permit movement of the strand through the guide during deployment.

36. The device as in claim 33, 34, or 35 wherein said head and foot panels, when deployed, partially overlap across a central region of the mattress.

37. The rescue or evacuation device as defined in claim 33, further comprising means for cleating said strand when pulled to tighten said retaining panel across said mattress.

38. An evacuation device for a non-ambulatory person adapted to cooperate with, and to be secured to, a mattress, stretcher, or like horizontal rest means, comprising:

at least two sheets of use in covering said person;

at least two pairs of cords, each pair fixedly attached to a respective sheet of said at least two sheets and slidably attached to respective handles attached to respective sheets of said at least two sheets; and securement means engaging said cords, for securely enclosing said person between said sheets and said securement means;

wherein said securement means includes for each pair of cords at least two cleats, with each of the cleats fixed to a respective edge of one of said at least two sheets and with each cleat having an opening for travel of a respective one of said at least two pairs of cords.

39. An evacuation or rescue device for a non-ambulatory person, comprising:

at least one sheet for covering substantially all of said person;

at least one cord for enclosing said person between said at least one sheet and a support for said person;

at least one cleat, attached to a respective first area of said at least one sheet and for deployment along the upper surface of said support; and a batten attached to said sheet parallel to the transverse axis of said sheet and serving to keep said sheet spread across the full width of said support while said device is being used.

40. An evacuation device for a non-ambulatory person, comprising:

a flexible sled-like slab for supporting and transporting said person across a floor; and a plurality of rolling means, including a roller in a socket, embedded in a bottom, floor-proximal surface of said sled-like slab;

wherein said flexible sled-like slab comprises a plurality of individually rigid or semi-rigid segments flexibly linked together along adjacent edges.

41. An evacuation device for a non-ambulatory person, comprising:

a flexible sled-like slab for supporting and transporting said person across a floor; and a plurality of rolling means, including a roller in a socket, embedded in a bottom, floor-proximal surface of said sled-like slab;

wherein said bottom, floor-proximal surface has a predetermined area thereof providing significant friction when in contact with stairways or the like.

42. An evacuation device for a non-ambulatory person, comprising:

a flexible sled-like slab for supporting and transporting said person across a floor; and a plurality of rolling means, including a roller in a socket, embedded in a bottom, floor-proximal surface of said sled-like slab;

wherein said flexible sled-like slab comprises a plurality of individually rigid or semi-rigid segments flexible linked together along adjacent edges; and wherein at least one of said plurality of segments comprises an area of high friction material on the bottom, floor-proximal surface thereof.

43. An evacuation device for a non-ambulatory person lying on a mattress on a bed, comprising:

sheet means, stored under a foot end of said mattress, when not in use, for enclosing said person once said person is positioned between said mattress and said sheet means; and securement means for forcing said sheet means against said mattress;

wherein said sheet means, when deployed, covers said person at least up to the person's shoulders.

44. An evacuation device for a non-ambulatory person lying on a mattress on a bed, comprising:

sheet means, stored under a foot end of said mattress when not in use, for enclosing said person once said person is positioned between said mattress and said sheet means; and securement means for forcing said sheet means against said mattress;

wherein said sheet means has an aperture for said person's head to protrude through.

45. An evacuation device for a non-ambulatory person lying on a mattress on a bed, comprising:

first sheet means stowed proximal to a head end of said mattress;

second sheet means stowed proximal to a foot end of said mattress and adapted to cooperate with said first sheet means for enclosing said person once said person is positioned between said mattress and said first and second sheet means; and securement means for forcing said first and second sheet means against said mattress.

46. The evacuation device as set forth in claim 45, further comprising:

a flexible sled-like slab for supporting and transporting said person across a floor;

a plurality of rolling means, including a roller in a socket, embedded in a bottom, floor-proximal surface of said sled-like slab; and wherein said flexible sled-like slab comprises a plurality of individually rigid or semi-rigid segments flexibly linked together along adjacent edges.

47. The evacuation device as set forth in claim 45, further comprising:

a flexible sled-like slab for supporting and transporting said person across a floor;

a plurality of rolling means, including a roller in a socket, embedded in a bottom, floor-proximal surface of said sled-like slab; and wherein said bottom, floor-proximal surface has a predetermined area thereof providing significant friction when in contact with stairways or the like.

48. The evacuation device as set forth in claim 45, further comprising:

a flexible sled-like slab for supporting and transporting said person across a floor;

a plurality of rolling means, including a roller in a socket, embedded in a bottom, floor-proximal surface of said sled-like slab;

wherein said flexible sled-like slab comprises a plurality of individually rigid or semi-rigid segments flexible linked together along adjacent edges; and wherein at least one of said plurality of segments comprises an area of high friction material on the bottom, floor-proximal surface thereof.

* * * * *